US005598729A

United States Patent [19]

Hoffmann et al.

[11] Patent Number: 5,598,729

[45] Date of Patent: Feb. 4, 1997

[54] SYSTEM AND METHOD FOR CONSTRUCTING WALL OF A TUBE

[75] Inventors: Benjamin R. Hoffmann, Hopkins; David A. Staskelunas, Maple Grove, both of Minn.

[73] Assignee: Tandem Systems, Inc., Maple Grove, Minn.

[21] Appl. No.: 329,526

[22] Filed: Oct. 26, 1994

[51] Int. Cl.[6] ..... B21D 41/04

[52] U.S. Cl. ..... 72/8.5; 72/10.4; 72/69; 72/84

[58] Field of Search ..... 72/22, 23, 69, 72/81, 84, 8.5, 10.4

[56] References Cited

U.S. PATENT DOCUMENTS

| | | |
|---|---|---|
| 691,727 | 1/1902 | McTear . |
| 729,099 | 5/1903 | Smith . |
| 840,270 | 1/1907 | Thiel ..... 72/69 |
| 1,420,721 | 6/1922 | McNiff . |
| 1,471,952 | 10/1923 | Ford . |
| 2,026,133 | 12/1935 | Mapes . |
| 2,030,818 | 2/1936 | Harter . |
| 2,351,020 | 6/1944 | Dewey . |
| 2,388,545 | 11/1945 | Horak . |
| 2,406,059 | 8/1946 | Burch . |
| 2,408,596 | 10/1946 | Bednar et al. . |
| 2,434,737 | 1/1948 | Enghauser . |
| 2,541,065 | 2/1951 | Jabour . |
| 2,663,206 | 12/1953 | Whiting et al. . |
| 2,699,596 | 1/1955 | Aronson . |
| 2,726,561 | 12/1955 | Hill . |
| 2,900,712 | 8/1959 | Keating . |
| 3,050,023 | 8/1962 | Brown . |
| 3,380,275 | 4/1968 | McGraw, Jr. . |
| 3,496,747 | 2/1970 | Delmar et al. . |
| 3,594,894 | 7/1971 | Mayer, Jr. . |
| 3,672,317 | 6/1972 | Halling et al. . |
| 3,685,475 | 8/1972 | Banks, Jr. . |

(List continued on next page.)

FOREIGN PATENT DOCUMENTS

| | | |
|---|---|---|
| 0081700 | 6/1983 | European Pat. Off. . |
| 0119141 | 9/1984 | European Pat. Off. . |
| 2465532 | 3/1981 | France . |
| 2481237 | 10/1981 | France . |
| 537094 | 11/1931 | Germany . |
| 1085657 | 4/1984 | U.S.S.R. . |
| 1423221A1 | 9/1988 | U.S.S.R. . |

OTHER PUBLICATIONS

Partners for Metal Working by Autospin, Inc.
ASE Model AS 23.30–CNC High Performance Machines for Endclosing and Endforming by Autospin, Inc.
Silencer Production by Autospin, Inc.
Machine Series for Forming Profiles V–Belt Pulleys for Drive Engineering by Autospin, Inc.
DW 326 CNC by Autospin, Inc.
Heavy Duty Spinning Machine PNC 75R by Autospin, Inc.
PNC Spinning, Shear Forming and Necking–in Machines by Autospin, Inc.
Spinning and Flow Forming Spinning and Flow Forming Technology, Product Design, Equipment, Control Systems by Leifeld GmbH (1994).

*Primary Examiner*—Lowell A. Larson
*Attorney, Agent, or Firm*—Merchant & Gould

[57] ABSTRACT

An apparatus for constricting an end of a metallic tube (or worktube) to form an arcuate-walled portion that has an outer surface is provided. The apparatus comprises a means for rotating the tube on its axis, a movable means for heating an end portion of the tube, and a forming rolling means. The forming rolling means includes a forming roller adapted for applying pressure on the end portion of the tube along successive lines of contact to constrict progressively the end of the tube. The movement of the forming rolling means is orchestrated with the movement of the means of heating. In a preferred embodiment, each line of contact has a substantially straight portion.

33 Claims, 20 Drawing Sheets

Microfiche Appendix Included
(43 Microfiche, 1 Pages)

U.S. PATENT DOCUMENTS 3,740,986 6/1973 Schmid .
3,779,060 12/1973 Schröder .
3,793,863 2/1974 Groppini .
3,815,395 6/1974 Sass ..... 72/69
3,823,591 7/1974 Schröder et al. .
3,846,886 11/1974 Schröder et al. .
3,874,209 4/1975 Maiorino .
3,889,835 6/1975 Avant et al. .
3,926,025 12/1975 Schröder et al. .
3,962,896 6/1976 Bichel .
3,964,412 6/1976 Kitsuda .
4,018,072 4/1977 Davis .
4,023,696 5/1977 Anagnostidis .
4,074,106 2/1978 Nee .
4,118,846 10/1978 Korte .
4,157,779 6/1979 Ishii et al. .
4,238,944 12/1980 Duffy .
4,320,848 3/1982 Dye et al. .
4,361,360 11/1982 Kuether .
4,383,556 5/1983 Evgenievich et al. .
4,418,557 12/1983 Halene .
4,441,354 4/1984 Bodega .
4,502,310 3/1985 Gnutov et al. .
4,554,810 11/1985 Jurus ..... 72/84
4,711,110 12/1987 Castricum .
4,760,725 8/1988 Halasz .
4,838,064 6/1989 Päss .
5,085,131 2/1992 Barrett et al. .
5,152,452 10/1992 Fendel .
5,235,837 8/1993 Werner .

XXX
XXX

SYSTEM AND METHOD FOR CONSTRUCTING WALL OF A TUBE

A portion of the disclosure of this patent document contains material which is subject to copyright protection. The copyright owner has no objection to the facsimile reproduction by any one of the patent disclosure, as it appears in the Patent and Trademark Office patent files or records, but otherwise reserves all copyright rights whatsoever.

MICROFICHE APPENDIX

The microfiche appendix to the present patent application contains the source code for the application software for generating a program for operating an apparatus to restrict a tube. The microfiche appendix has 43 frames. Copyright© 1994 TANDEM SYSTEMS, INC., Maple Grove, Minn.

FIELD OF THE INVENTION

The present invention relates to an apparatus and method for constricting and changing the shape of cylindrical metallic tubes.

BACKGROUND OF THE INVENTION

Most tanks and vessels are manufactured in accordance with specific codes and standards, e.g., ASME Boilers & Pressure Vessel Code, DOT Code, AAR Code, and the like. To meet these standards, some vessels are manufactured by certain accepted methods. For thick-walled vessels, hollow cylindrical structures such as metallic tubes have been constricted at the ends to form vessels and tanks, such as high pressure tanks and fire extinguishers. One method of constricting the ends of hollow cylindrical structures to form high pressure tanks is by rotating the cylindrical structure, heating the end portions thereof and applying pressure on that heated end portions. For example, U.S. Pat. No. 2,699,596 (Aronson) discloses a process for making gas pressure cylinders by heating the side walls of a tube and spinning metal from the side walls into the bottom of the pressure vessel. Similarly, U.S. Pat. No. 2,408,596 (Bednar et al.) discloses a method for forming cylinder ends by torch-heating, rotating, and applying pressure to a cylindrical work piece. Pressure is applied by a tool moving in arcuate paths. U.S. Pat. No. 2,406,059 (Burch) discloses a process for spinning hollow articles suitable for closing the end of a tube. The end portion of the tube is heated by a heating means such as an oxy-acetylene flame. Pressure is applied by means of a flat-faced tool to the end portion of the tube to close it. Manfred Runge in "Spinning and Flow Forming," Verlag Moderne Industrie, 1994, discloses hot spinning to close thick-walled tubes for making high-pressure gas bottles. In such hot spinning on thick-walled tubes, induction coil is described as usable for preheating a tube. When spinning, gas burners are used for compensating for heat loss by the tube. Cold spinning using mandrels is also disclosed. Such a method can be used for making large thin-walled tank ends.

While spinning using mandrels can be employed to make thin-walled tank heads (or ends), such tank heads must be welded to each other or to a tube to result in a closed vessel since there is no good way of removing a mandrel from a closed vessel. Furthermore, in hot spinning a large, thin-walled structure, the relatively large surface area to volume ratio leads to rapid heat loss, thereby making it difficult to maintain temperature. Moreover, compressive stresses acting parallel to the surface of a thin-walled tube may bend, wrinkle, and collapse the tube because positive external pressure tends to buckle the surface. The resistance of the tube to buckling is proportional to a number ranging from the second to the third power of the tube thickness, depending on location along the tube and other factors. Thus, wrinkling and buckling is a severe problem in making thin-walled vessels. Techniques found to be useful for thick-walled vessels do not work on thin wall vessels. Forming such vessels by spinning without a mandrel is difficult.

Recently, U.S. Pat. No. 5,235,837 (Werner) discloses an apparatus for producing thin-walled cylindrical pressure vessels or tanks through metal spinning operations. The end caps of the vessels are formed from a hollow, thin wall cylindrical worktube. Forming rollers are moved along a plurality of arcuate stroking paths. The worktube is heated by heating torches. By controlled programming of the motion of the forming rollers, the forces applied to the worktube by the forming rollers, and the temperature of the tube, controlled distribution of the metal thickness in the knuckle zone can be accomplished. This method can provide greater thickness in the knuckle zone to strengthen it. As used herein, the term "knuckle zone" refers to the zone on the vessel at which the noncylindrical part is connected to the cylindrical part.

Unfortunately, flame heating can lead to oxidation and deterioration of the metallic tube. Methods have been devised to reduce the deterioration of steel in heat spinning processes. U.S. Pat. No. 3,594,894 (Mayer Jr.) discloses a method for forming a cartridge by heating a uniformly thick tubular material to a temperature slightly above the recrystallization temperature of the material and forming the material in dies heated to a temperature below the recrystallization temperature of the material. A heating means that may contain an inductive coil can be used to completely surround the ends of the tubular material and allow control of the tube temperature to a temperature slightly above its recrystallization temperature. A disk is used for sealing the end of the cartridge by welding. U.S. Pat. No. 3,964,412 (Kitsuda) discloses a shaping device in a circulation system for producing a high pressure gas container by successively drawing a workpiece at a series of workstations. The workpiece is mounted on a turn table and heated by a high frequency induction heater at a stop position after the first stop position or at any subsequent stop position where the workpiece can still be drawn.

Uniform heating, particularly of larger vessels, is difficult to achieve. Heating torches tend to concentrate the heat at the spots directly impinged by the flames. For heating larger tubes, many flame nozzles (or torches) will be needed. The iteration of these flame nozzles can lead to overheating and failure of adjacent nozzles. Further, open heating by flame nozzles is inefficient as a low percentage (5–10%) of the energy is transmitted to the workpiece while the rest is dissipated to the environment. If hotter but fewer flame nozzles are used, the hotter temperature will lead to accelerated deterioration of the metal. On the other hand, inductive heating has not been shown to be capable of effectively heating large metallic tubes for spinning, particularly those with large diameter to tube wall thickness ratios.

SUMMARY

The present invention provides an apparatus for constricting an end of a metallic tube (or worktube) to form an arcuate-walled portion that has an outer surface. The apparatus comprises a means for rotating (or spinning) the tube on its axis, a movable means for heating an end portion of the tube, and a forming rolling means. The forming rolling means includes a forming roller adapted for applying pressure on the end portion of the tube along successive lines of contact to progressively constrict the end of the tube. The movement of the forming rolling means is orchestrated with the movement of the means of heating. As used herein, the term "movable" relating to the heating means refers to either the orientation, (i.e., the direction to which the means faces) or the translational position of the means. The term "orchestrated" is used to describe the arranged movements of two or more devices relative to each other to achieve a desired effect. The devices are moved independently in a changeable harmonious relationship, i.e., the devices are not rigidly tied together in orientation or position. The term "tube" includes the tube whose end portion is being constricted, said tube having a generally tubular structure prior to constriction. In a preferred embodiment, each line of contact has a substantially straight portion.

In another aspect, the invention of the present invention also provides an apparatus for inductively heating an end portion of a tube wherein the end portion progressively changes shape. The apparatus comprises an inductive coil means for heating and a means for moving at least one portion of the inductive coil means to adapt to the changing shape of the tube to heat a desired portion of the tube. The inductive coil means has an inductive coil whose orientation and position relative to the tube is reconfigurable to conform to the shape of the end portion of the tube.

The present invention further provides a method of inductively heating an end portion of a metallic tube wherein the end progressively changes shape. The method comprises positioning an inductive coil means having an inductive coil so that the inductive coil is proximate the end portion of the tube for inductive heating, producing a magnetic field using the inductive coil means, and reconfiguring the orientation of the inductive coil relative to the tube to conform to the shape of the end portion of the tube as the tube changes shape so that the inductive coil remains proximate to the end portion of the tube for inductive heating.

In another aspect, the present invention also provides a method for constricting an end of a metallic tube to form an arcuate-walled portion that has an outer surface. The method comprises rotating the tube on its axis, heating an end portion of the tube, and applying pressure on the end portion of the tube to constrict progressively the end of the tube. The pressure is applied along successive lines of contact wherein each line of contact has a substantially straight portion.

In yet another aspect of the invention, the heating and application of pressure to the end portion of the tube are done in an orchestrated manner at varying locations as the tube progressively changes shape. The present invention also provides metallic tubular structures made by the methods described hereinabove.

The present invention also provides a computer system for controlling a forming tool and a heating means for constricting a rotating tube. The computer system comprises a means for receiving input parameters; a means for calculating, based on the input parameters, the orientation and positions of the forming tool and the heating means for orchestrated movement of the forming tool and the heating means relative to the tube as the tube changes shape to constrict the tube; a means for displaying the information on the orientation and positions of the forming tool and the heating means; and a means for electronically communicating the calculated orientation and positions to means that move the forming tool and the heating means.

The apparatus and method of the present invention can be advantageously applied to make cylindrical structures such as tanks and containers, either thick-walled (sometimes called "thick-shelled," e.g., having a diameter to wall thickness (D/t) ratio of about 15:1 to 50:1) or thin-walled (sometimes called "thin shelled", having a D/t ratio of greater than 50:1, e.g., greater than 100:1).

In prior art processes for making larger (e.g., greater than 12 inches (30 cm) in diameter) vessels, typically the heads (i.e., the ends of the vessels) are made separately by stamping, cold spinning on mandrels, or forging and subsequently welded to the tubes. Such methods are labor-intensive and wasteful since material remaining after the stamping process is scraped. Further, if the tube is not exactly round, it may not match the round heads. The present invention obviates the need for stamping and welding the heads as well as matching the heads to the tube, thereby reducing waste and labor. Unlike the prior art processes that requires matching heads to tubes, the apparatus of the present invention can be used to make a vessel of any size within a range by starting from a rectangular sheet of metal. Vessels with ends of a variety of shapes (e.g., round, elliptical, conical, toriconical or related symmetrical shapes) can be made with the apparatus and method of the present invention. Therefore, there is no need for an inventory of tubes and heads of different shapes and dimensions.

In another respect, compared to prior art spinning processes, which have been applied in making relatively small diameter (e.g., less than 10 in (25 cm)) thick-walled vessels, such as high pressure gas cylinders and fire extinguishers wherein the closed end portions have thicker wall than the cylindrical portions, the present invention, in addition to making cylindrical structures as prior art spinning processes, provides the advantage that it can also be used to make larger (e.g. preferably more than 16 in. (40 cm) in diameter, with typical applications ranging from 16 inches to 120 inches in diameter), thin-walled vessels.

As previously stated, in making larger cylindrical structures, maintaining uniform elevated temperature for spinning is difficult. If flame nozzles (or torches) are used to heating, they have to be arranged and controlled to distribute heat evenly to reduce the risk of fire hazard and over- or under-heating. On the other hand, we have discovered that inductive heating, although posing a lesser fire hazard, cannot be simply applied to a larger cylindrical structure by increasing the size of the inductive heating means.

Because thin-walled tanks cool very rapidly, we have found that heating and forming must occur simultaneously. Solenoidal coils wrapped around the tanks circumference are unsatisfactory since they restrict access of the forming roller to the outer surface of the tank. We have discovered smaller "pancake" coils can be used and applied to areas of the surface remote from the forming rollers. For example, the forming roller and induction heating pancake coil may be located on opposite sides of the spun shape. Planar induction coils (pancake coils) must be generally parallel and close to the surface being heated. We have found that for efficient heating to take place, preferably the surface of the coil is within about 0.5 inches of the surface of the tank. Therefore, we have found that moving the induction heating coil (e.g., pancake coil) to stay closely coupled to the tank surface as the tank is formed and changes shape is very effective in heating the tank to maintain the desired temeprature.

Moreover, we have found that surfaces that have abrupt changes in curvature are very difficult to heat uniformly with induction coils. In particular, heating energy is concentrated at these abrupt changes in curvature, giving rise to material failure. To overcome this problem, we developed spinning trajectories for which shapes intermediate to the beginning and ending shapes do not exhibit abrupt changes in surface curvature. This is accomplished by pressing a forming roller on the tube in successive lines of contact wherein each line of contact has a proximal endpoint more distal to the previous one. The term "spinning trajectory" refers to a pass of the forming roller which causes the end portion of the tube to change shape.

Furthermore, we have developed a series of straight line trajectories that taken collectively form a compound curved surface, for example a hemisphere. Such trajectories are referred to as "tangential spinning trajectories" herein because each straight line forming pass is tangent to the desired end shape.

Thus for any straight line pass the part of the surface proximate (less distal) to the starting point will have been formed to match the desired ending shape by previous passes of the forming tool. As used herein, the term "proximal" refers to a location towards the midpoint of the tube and the term "distal" refers to a location towards the end of the tube. Furthermore, by progressively moving the heating coil to leave behind the part of the arcuate portion that has been formed and "tangential spinning", i.e., utilizing successive, progressively changing spinning trajectories each of which has a straight portion tangential to the arcuate portion, the risk of failure of the knuckle zone due to localized heating can be further reduced.

In tangential spinning, the area of the surface distal to the beginning of a straight line pass is conical as formed by the previous straight line pass. This conical area offers the advantage of not having abrupt changes in curvature, and is therefore possible to inductively heat uniformly to enable further forming.

The orchestrated movement of the heating coil (i.e., the heating element) and the forming roller as the end portion of the tube progressively changes shape allows the temperature, the shape, and the thickness of the end portion to be controlled. Based on a predetermined set of parameters, feedback control utilizing continually monitored data on temperatures, forces, and speeds of rotation, as well as data on locations and orientations of the heating coil and the forming roller, enables automatic control of the apparatus to produce a cylindrical structure with an arcuate-walled end portion.

BRIEF DESCRIPTION OF THE DRAWING

Referring to the accompanying drawing, wherein like reference numerals represent like corresponding parts in the several views, wherein the figures are not drawn to scale to show details.

DESCRIPTION OF THE PREFERRED EMBODIMENT

Figure 1:
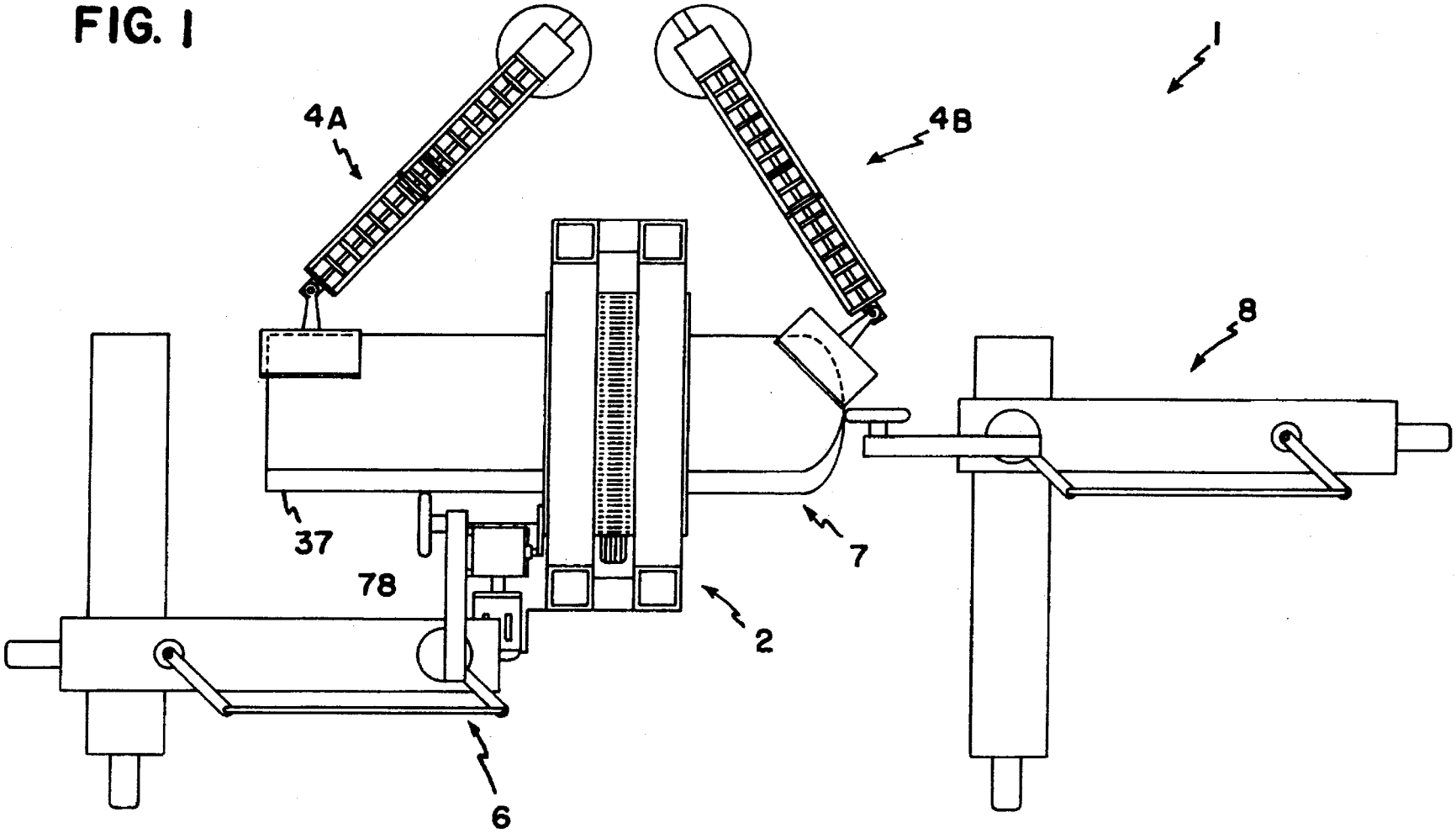
FIG. 1 is a top elevation view of a preferred embodiment of the apparatus of the present invention with a tube mounted within the apparatus.

In accordance with the present invention, the preferred embodiment as shown in FIG. 1 is illustrative of the apparatus of the present invention. In this preferred embodiment, an end on a tube (or shell) to be constricted is heated inductively as the tube is rotated on its axis. A forming roller is used to apply pressure on an end portion of the tube along successive lines of contact each having a straight portion so that the end of the tube is progressively constricted.

The following is a list of terms and brief description relating to their use herein.

1. Free End or Free Edge—This is the edge of the shell (or tube). It is one end of the heated zone. The other end of the heated zone is the knuckle area.
2. Thin Shell—Generally a cylindrical shell with a diameter to wall thickness ratio greater than 50 to 1, preferably greater than 100 to 1.
3. Thick Shell—Generally a cylindrical shell with a diameter to wall thickness ratio less than 50 to 1.
4. Head—Heads are pre-formed shapes. Conventional tanks are closed by welding heads on the ends.
5. Induction Heating—Heating metal using alternating magnetic fields. These induce eddy currents, which dissipate their energy in the form of heat.
6. E-Stop—Emergency Stop. This is where something has gone wrong and the machine controls automatically stop all machine operations. Alternatively, the machine tool operator can manually invoke an E-Stop. E-Stop is especially important from a human safety point of view. For example, during shake down testing of a program, a person may have a hand in one of the machine tool pinch points. Obviously, as soon as this is discovered, the operator would want to invoke an E-Stop. See also E-Return.
7. E-Return—Emergency Return. This is similar to an E-Stop. However, since the tank may be very hot, it is often desirable to withdraw the form tool and inductor away from the tank. Thus, if something goes wrong during spinning, and it is not a human safety issue, usually the machine or machine tool operator will invoke an E-Return instead of an E-Stop. See also E-Stop.
8. Flame Heat—Heating method utilizing fuel gas/oxygen mixture through torches.
9. Pressure Vessel—A closed container (commonly metallic) capable of containing media under pressure.
10. Mandrel—A shaped form against which material is spun. A mandrel is not used for free air spinning.
11. Motion Control—The use of programmable computers and components to actuate mechanical components.
12. Diameter to Thickness Ratio (D/t)—The ratio of the nominal outside diameter of a shell to the nominal thickness of the shell.
13. Trajectories/Transitional Tank Shapes—The path programmed and followed by the forming tool and the modified shape of the shell during the spinning process.
14. Arcuate Paths—Trajectories and transitional shapes of a curved nature.
15. Tangent Paths—Trajectories and transitional shapes whose beginning points are substantially tangent to the final desired shape of the end being formed.
16. Elliptical Heads—A tank end in which the axial axis is shorter than the radial axis.
17. Hemispherical Heads—A tank end which has a hemispherical shape.
18. Toriconical Heads—A tank end which has a conical shape.
19. Out of Roundness—The difference in the measured minimum diameter and the measured maximum diameter.
20. Seamless Shell—A cylindrical shell which is made from seamless tube or pipe.
21. Single End—Closing one end of a shell at a time via the spinning process.
22. Double End—Closing both ends of a shell simultaneously via the spinning process.
23. Oxidizing Flame—A flame with a high oxygen to fuel gas ratio (excess oxygen) which increases flame temperature.
24. Oxidation—The chemical reaction which causes formation of ferric oxide which is accelerated in the presence of excess oxygen.
25. Pitch—In spinning this is the axial movement of the form tool for each revolution of the shell expressed in inches/revolution.

26. Arc Length—The shell length from the point of initial forming to the free end of the shell, as measured along the surface of the shell.
27. Heat Transfer Efficiency—The amount of heat energy absorbed by the part to be heated as a percentage of the total heat output of the heating means.
28. Stress Relieving—The process of heating material to the point that any residual stresses present in the material are relaxed.
29. Solenoidal Coil—An induction heating coil of solenoidal shape that surrounds the part to be heated.
30. Non-Solenoidal Coil—An induction heating coil that does not completely enclose the part to be heated. This is sometimes referred to as a "pancake coil".
31. PID Control—(Proportional-Integral-Derivative Control) A commonly used feedback process controller.
32. PLC—A Programmable Logic Controller generally used to control a sequence of machine events based upon timers and external inputs.

Referring to FIG. 1, the preferred apparatus 1 for constricting an end of a tube has a means 2 for rotating (spinning) the tube on its axis, a pair of means 4A, 4B for heating the two end portions of the tube, a pair of means 6, 8 for rounding the two end portions of the tube 7 and for applying pressure on the two end portions of the tube 7 to constrict the ends of the tube (as shown in FIG. 1, means 6 is positioned for rounding, and means 8 is positioned for constricting). These means are secured to a common structure, such as a platform or foundation (not shown) so that these various means can function cooperatively, and in an orchestrated manner, to heat and constrict the end (i.e., end portions) of a tube.

Figure 3:
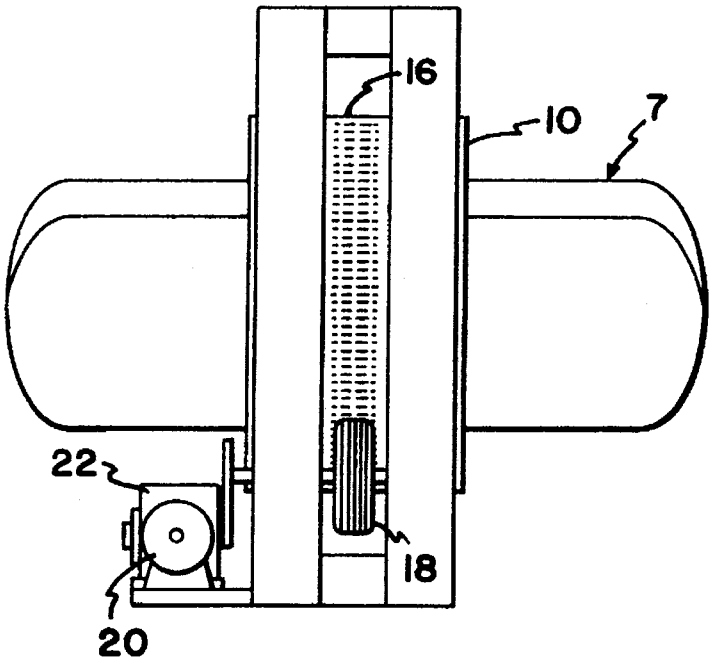
FIG. 3 is a side view of the tube rotating mechanism of FIG. 2.
Figure 2:
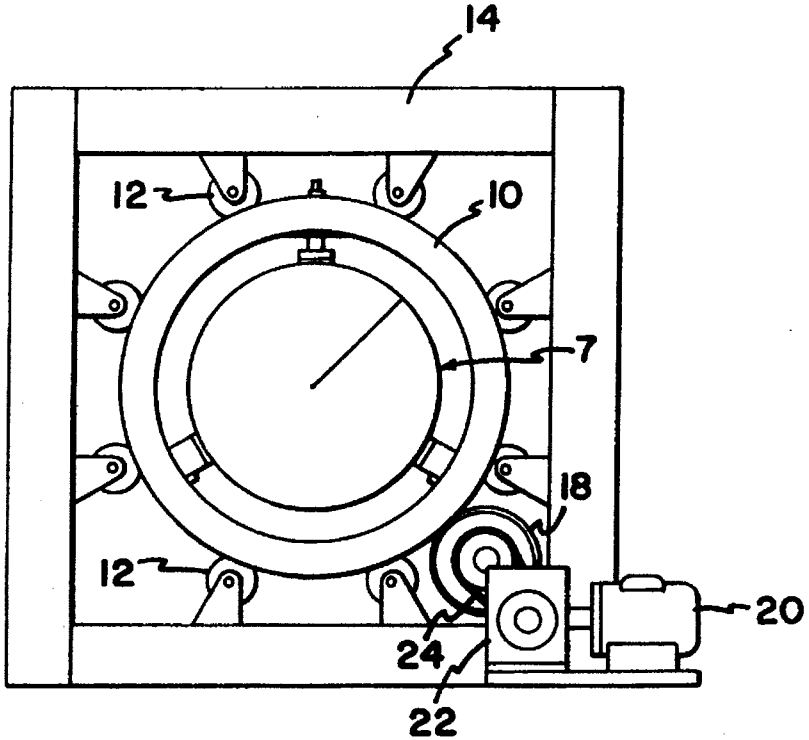
FIG. 2 is an end elevation view of the mechanism for rotating a tube in the present invention, showing a metallic tank secured in that mechanism.

Referring to FIGS. 2 and 3, the means 2 for rotating the tube 7 has a guide ring 10 through which the tube extends and is secured thereto. Therefore, as the guide ring 10 rotates, the tube 7 is caused to rotate on its axis, which preferably is identical to the axis of rotation of the guide ring. The guide ring 10 is supported by a plurality of guide rollers which in turn are affixed in a frame 14. The guide ring 10 has a knurled outer surface 16 which contacts a drive wheel 18. The traction of the rim (or periphery) of the drive wheel 18 on the knurled surface 16 of the guide ring 10 causes the guide ring to rotate as the drive wheel is rotated. A motor 20 driving a gear box 22 is used to rotate the drive wheel by means of a belt 24.

Figure 5:
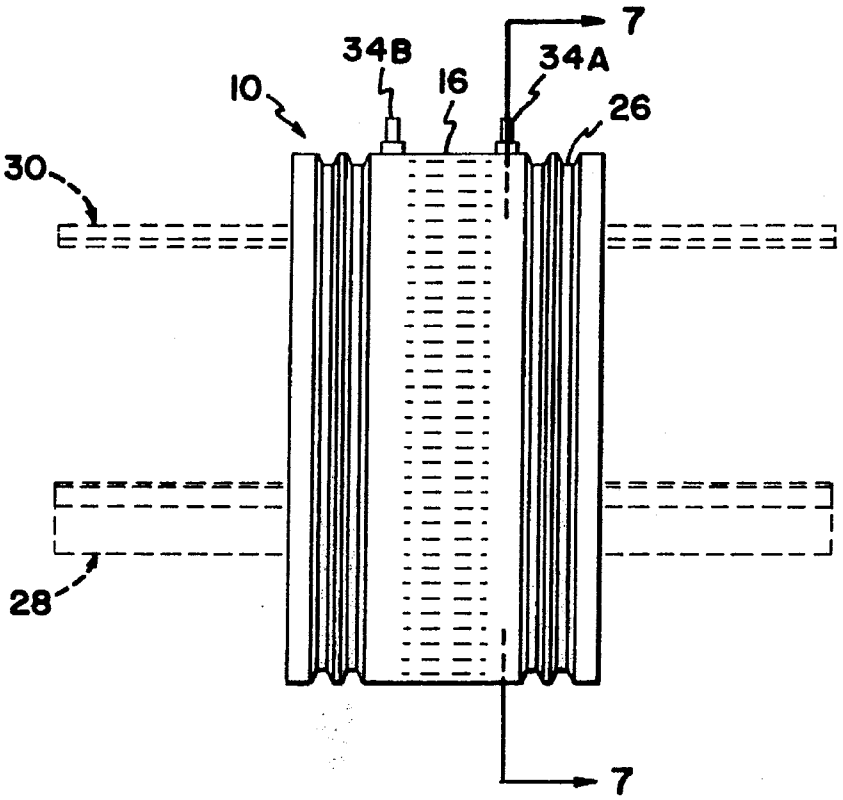
FIG. 5 is a side view of a portion of the rotating mechanism of FIG. 3 with parts omitted to show details, wherein support bars are shown in phantom.
Figure 4:
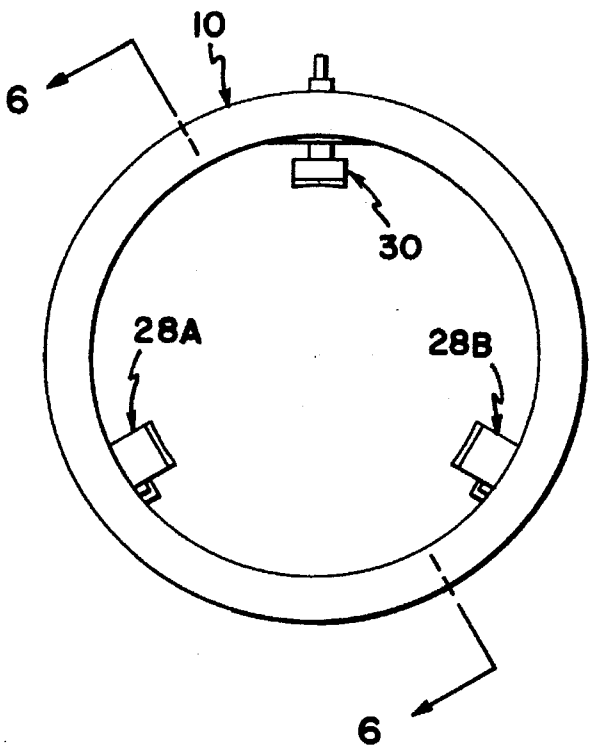
FIG. 4 is an end view showing details of a portion of the rotating mechanism of FIG. 2.
Figure 6:
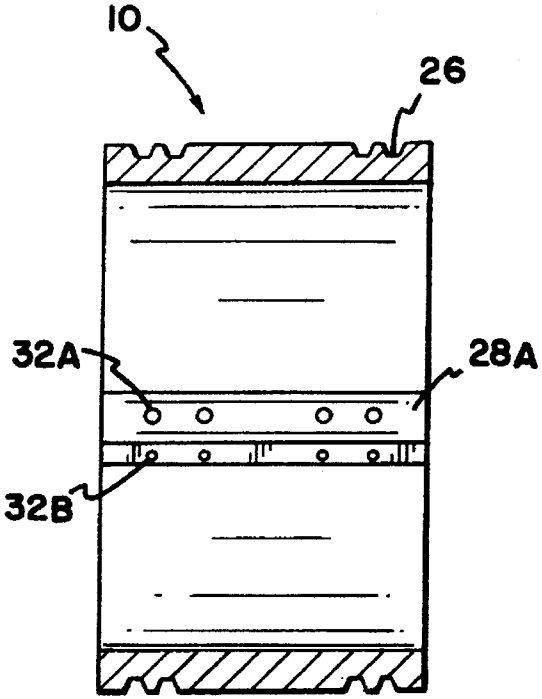
FIG. 6 is a cross-sectional view of a portion of the apparatus in FIG. 4 along the line 6—6.
Figure 7:
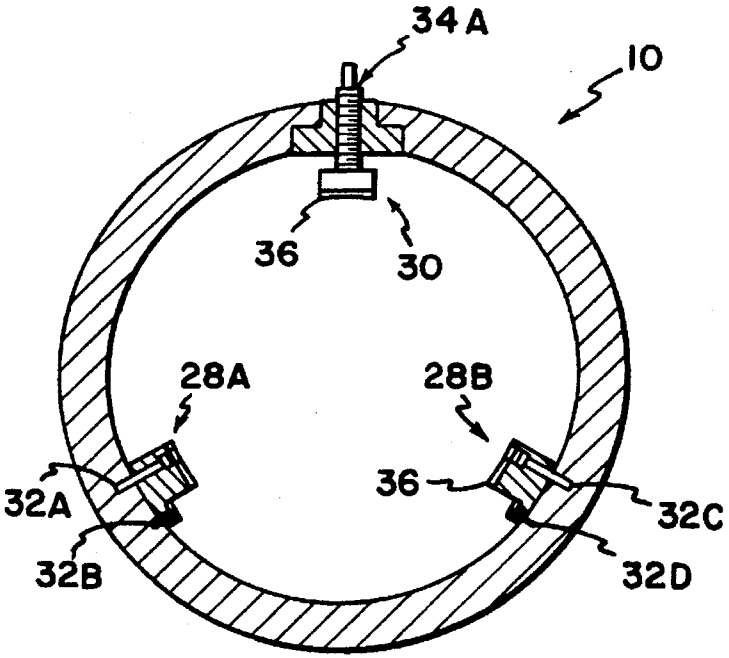
FIG. 7 is a cross-sectional view of the portion of the apparatus of FIG. 5 along the line 7—7.

Referring to FIGS. 4 and 5, the guide ring 10 has grooves 26 defined on its outer surface for receiving the guide wheels 12 so that as the guide ring 10 is rotated, it remains axially stationary relative to the frame 14 and drive wheel 12. The guide ring 10 has first 28 and second 30 internal support bars extending axially on the internal surface thereof. Referring to FIGS. 6 and 7, a pair of first support bars 28A,28B are secured to the guide ring 10 by a plurality of bolts 32A, 32B,32C,32D. A second support bar 30 is secured to the guide ring by means of radially adjustable threaded shafts 34A,34B which resemble the threaded shaft of a bolt. The radially adjustable threaded shafts 34A,34B are screw-threadedly connected to the guide ring so that as such a shaft is turned relative to the guide ring it moves radially inward or outward depending on its direction of turning.

When a tube 7 is being affixed in a guide ring 10, the radially adjustable threaded shafts are first moved radially outward to allow the tube to extend through the guide ring. After the tube 7 is disposed in the guide ring 10 in a desired axial position, the radially adjustable threaded shafts 34A, 34B are moved radially inward relative to the guide ring so that the second support bar 30 is pressed against the outer surface of the tube 7. In this way, the tube 7 is securely disposed in the guide ring 10. The dimensions of the guide ring 10, the support bars 28,30, and the radially adjustable threaded shafts 34 are selected such that for a tube 7 of a specific diameter, when disposed in a selected guide ring 10, the axis of rotation of the tube coincides with the axis of rotation of the guide ring. The support bars each has a radially inwardly facing layer 36 which frictionally contacts the outer surface of a tube. The layers 36 have a high coefficient friction so that the tube can be securely disposed in a guide ring.

Figure 9:
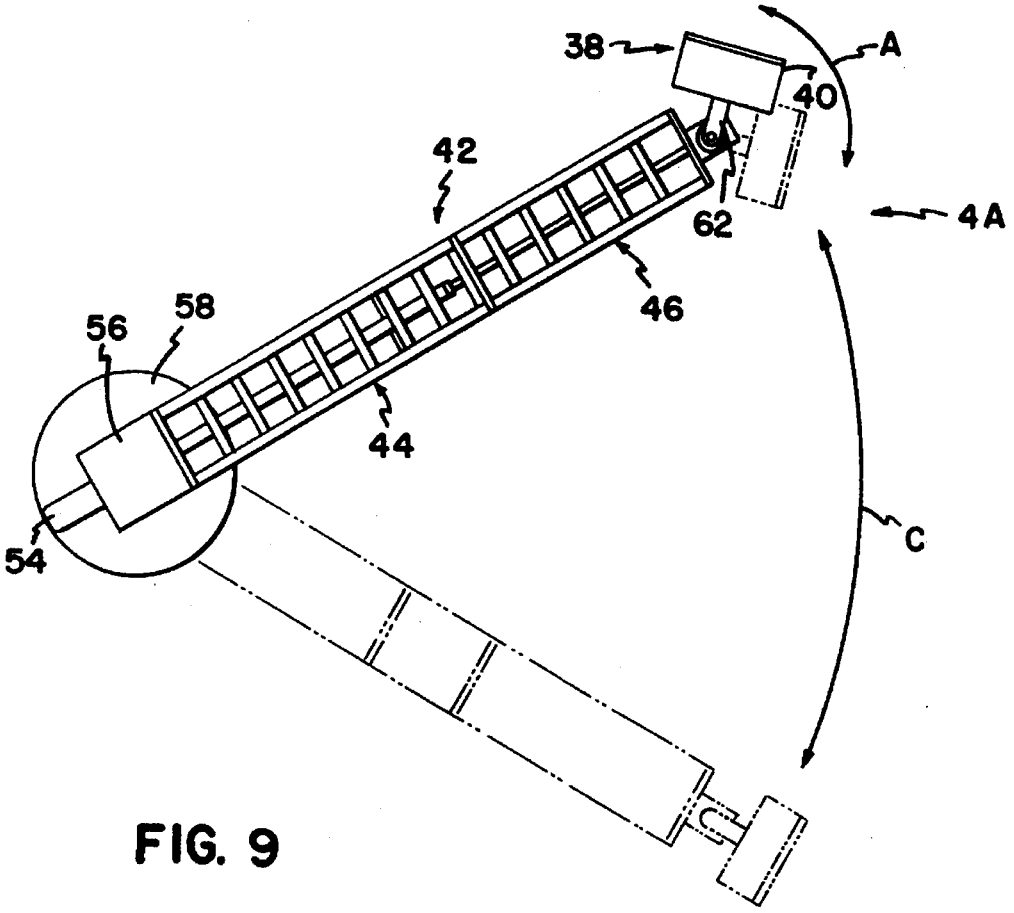
FIG. 9 is a top elevation view of the heating mechanism of the embodiment of FIG. 1.
Figure 8:
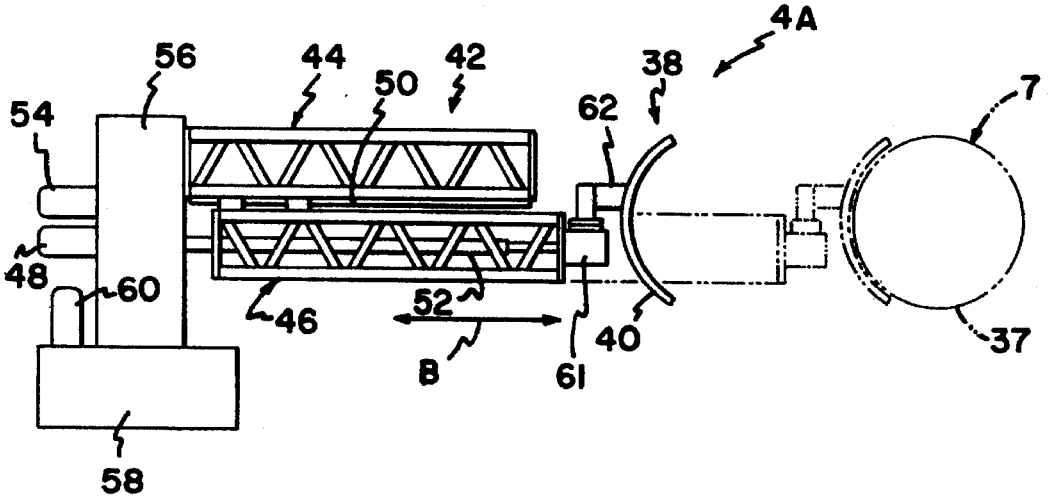
FIG. 8 is a side elevation view of the heating mechanism of the embodiment of FIG. 1.

Referring to FIGS. 8 and 9, the means for heating (e.g. 4A) the end portion 37 of the tube 7 has a mechanism for moving the heating element in at least two dimensions. For example, the mechanism can move the heating coil on a two dimensional plane with three degrees of freedom (as will be evident from the following description). The heating element 38 preferably has inductive coil means including one or more inductive coils (not shown in FIGS. 8 and 9) protected by an insulator 40. As shown in FIGS. 8 and 9, the heating element 38 is pivotally connected to an extendible arm 42 so that the heating element 38 can be rotated on a horizontal plane parallel to (the foundation and to the axis of the tube 7). Arrowed line A shows the pivotal movement of the heating element.

The extendible arm 42 has a first portion 44 and a second portion 46 operatively connected together such that the overall length of the extendible arm can be lengthened or shortened by moving the second portion relative to the first portion so that the distance from the heating element to the tube can be varied. A motor 54 is used to effectuate the movement of the second portion 46 relative to the first portion 44. Preferably, the first portion 44 and the second portion 46 of the extendible arm are slidably connected together by means of guide rails 50 and the motor 54 drives a mechanism that moves the second portion 46 along the first portion 44. Arrowed line B shows the extending and contracting movement of the extendible arm.

A second motor 48 is operatively connected to a right angle gear box mechanism 61 by means of a telescopic shaft 52 to pivot the heating element 38 at the end of the second portion of the extendible arm. The first motor 54, the second motor 48, and the first portion 44 of the extendible arm 42 are mounted on a mounting column 56 which in turn is mounted on a base 58. Preferably, the mounting column 56 is adjusted vertically (i.e., in a direction perpendicular to the plane of pivoting of the heating element) when it is initially installed so that the heating means is at the correct height (the center line of the heating means is in the same horizontal plane as the center line of the shell) to heat the tube 7. Alternatively, a mounting column 56 that is vertically adjustable during the operation of the apparatus can be used. The column 56 is pivotally mounted on the base 58. A third motor 60 is used to drive the movement of the column 56 so that the extendible arm 42 can sweep in a plane perpendicular to the vertical axis (i.e., parallel to the plane of pivotal movement of the heating elements). Arrowed line C shows the pivotal movement of the extendible arm. By controlling the pivotal movement of the column, the extension of the extendible arm, the pivotal movement of the heating element, the heating elements can be precisely positioned at desired locations proximate to the surface of the end portion of the tube for inductive heating, even as the end portion progressively changes shape. As will be described below, the motors are computer controlled to provide orchestrated (or coordinated) movement with the forming tool.

Figure 10:
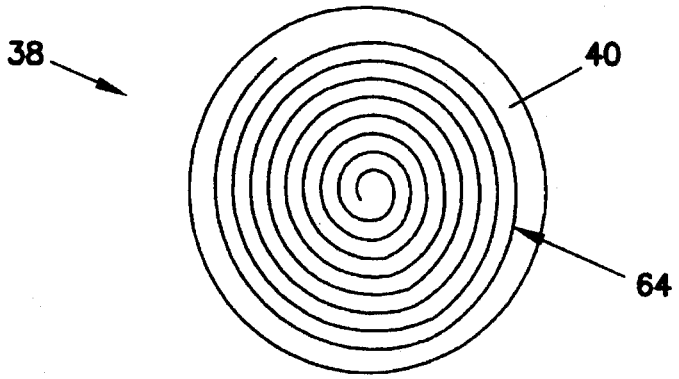
FIG. 10 is an elevation view showing the configuration of the inductive heating coil of a preferred embodiment of the inductive heating coil means of the present invention.
Figure 11:
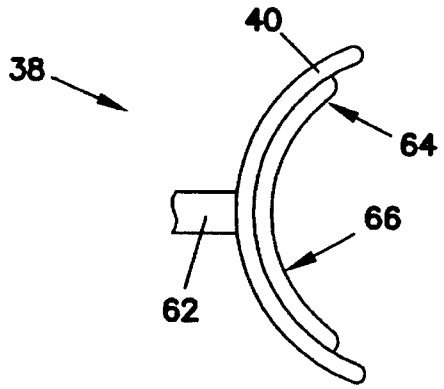
FIG. 11 is a side elevation view of the inductive heating coil means of FIG. 10.

Referring to FIGS. 10 and 11, the heating coil and the insulator 40 of the heating element 38 are supported by a hinged support arm 62, as previously stated, pivotally connected to the end of the second portion 46 of the extendible arm 42. The heating element 38 has an arcuate shape. An inductive heating coil 64 is disposed on the recessed (which is concave in heating coil 64) surface of the insulator 40 facing the tube. In this way, the heating element 38, including the inductive heating coil 64, has a concave surface 66 for positioning proximate to the outer surface of the tube. In the embodiment shown, the inductive heating coil 64 has a spiral configuration having a general appearance of a disk. It is understood that the recessed surface can be trough-shaped, bowl-shaped, and the like.

Figure 12:
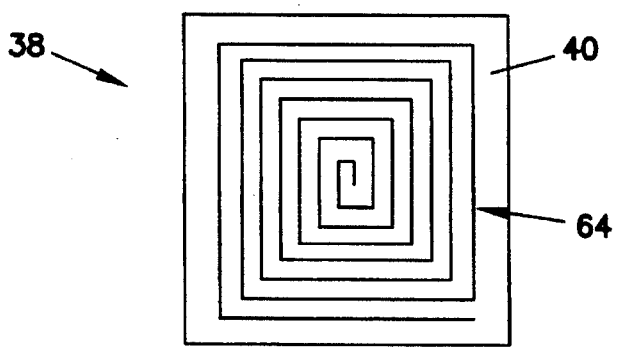
FIG. 12 is an alternative embodiment of an inductive heating coil means of the present invention.

Referring to FIG. 12, alternatively, the spiral of the inductive heating coil 64 can be wound such that it has the general appearance of a rectangular plate. Again, the general rectangular spiral inductive heating coil is configured to provide a concave surface for positioning proximate to the outer surface of a tube.

Figure 13:
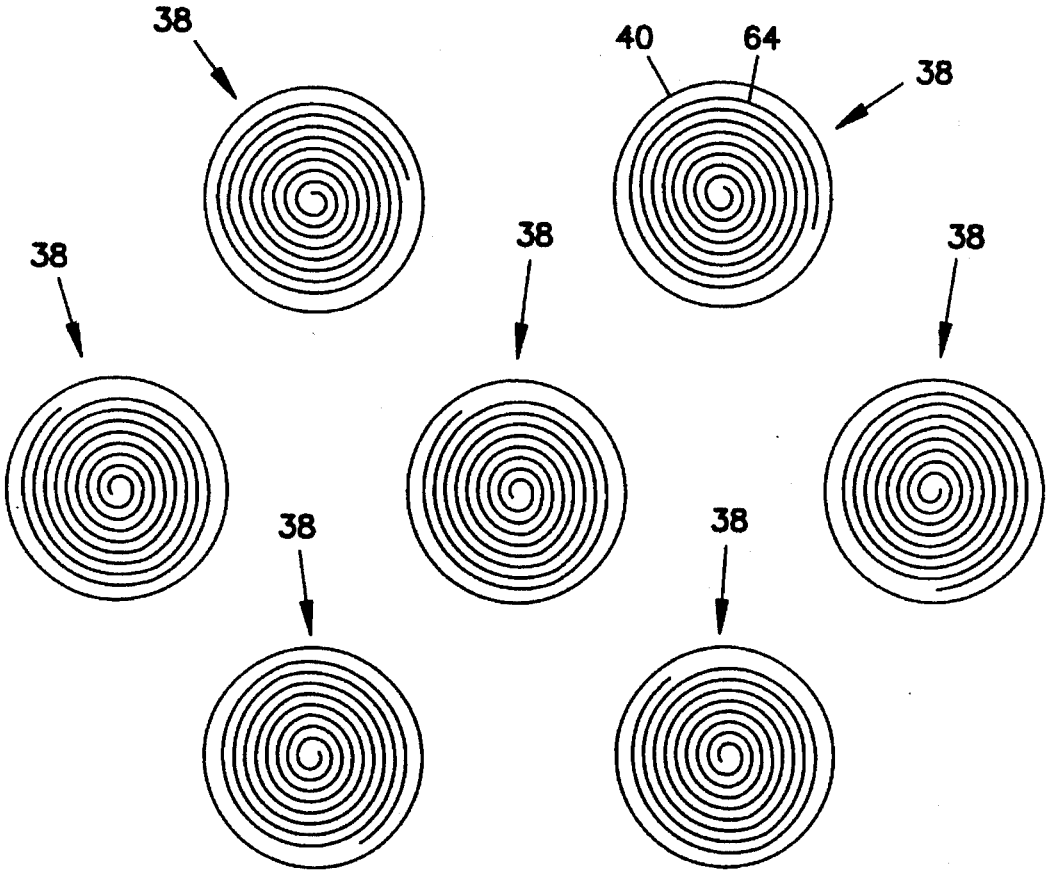
FIG. 13 is a schematic representation of another embodiment of the inductive heating coil configuration of the present invention.

FIG. 13 shows an alternative embodiment of a heating element having a plurality of inductive coils each of which can pivot and be moved independently of one another in a direction generally perpendicular to the plane of the coil. For example, referring again to FIGS. 8 and 9, the coils can each be pivotally supported by a second portion 46 of extension arm. The plurality of second portions 46, each supporting a heating coil, can be slidably connected to a common first portion 44 of extension arm. In this way, the inductive coils can be moved to a configuration corresponding to the changing shape of a tube in the spinning process.

Figure 14:
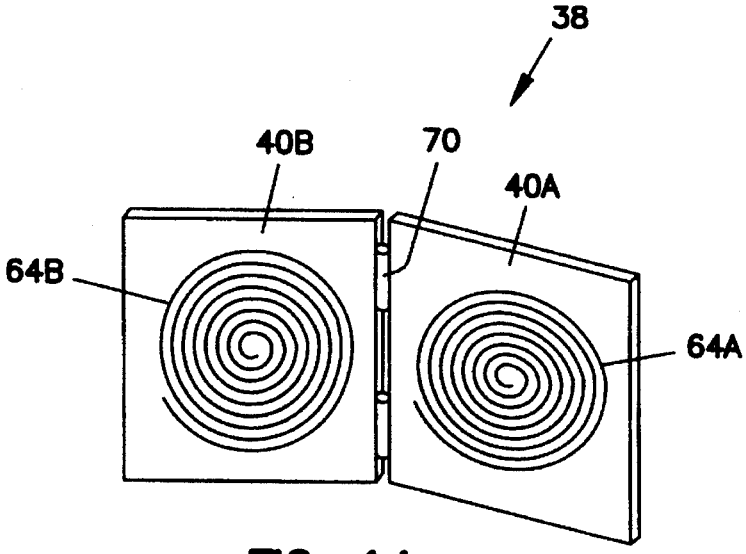
FIG. 14 is an isometric view of a further embodiment of the inductive heating coil means of the present invention.

FIG. 14 shows another embodiment of the heating element 38. In this embodiment, the inductive coil means is articulated (i.e., the two inductive coils are disposed in such a manner that they can move relative to each other by means of one or more hinges 70. In the embodiment of FIG. 14, the insulators 40A,40B on which the two inductive coils 64A, 64B are disposed are connected together but the coils are not connected. Alternatively, the inductive coils 64A,64B can be jointedly connected together to provide pivotal movement one to another. Generally, the heating element as shown in FIGS. 10–14 have heating coils that are not solenoids. Such non-solenoidal inductive heating coils, being relatively flat and having an arcuate configuration providing a recessed surface, are more adapted for positioning proximate to the outer surface of a tube. It is to be understood that since inductive heating is by magnetic flux, the insulators can be disposed between the inductive heating coil and inductive heating will still be practicable. The insulator can be made from thermal and electrical insulating materials such as ceramics, refractory fabrics, and the like.

Figure 15:
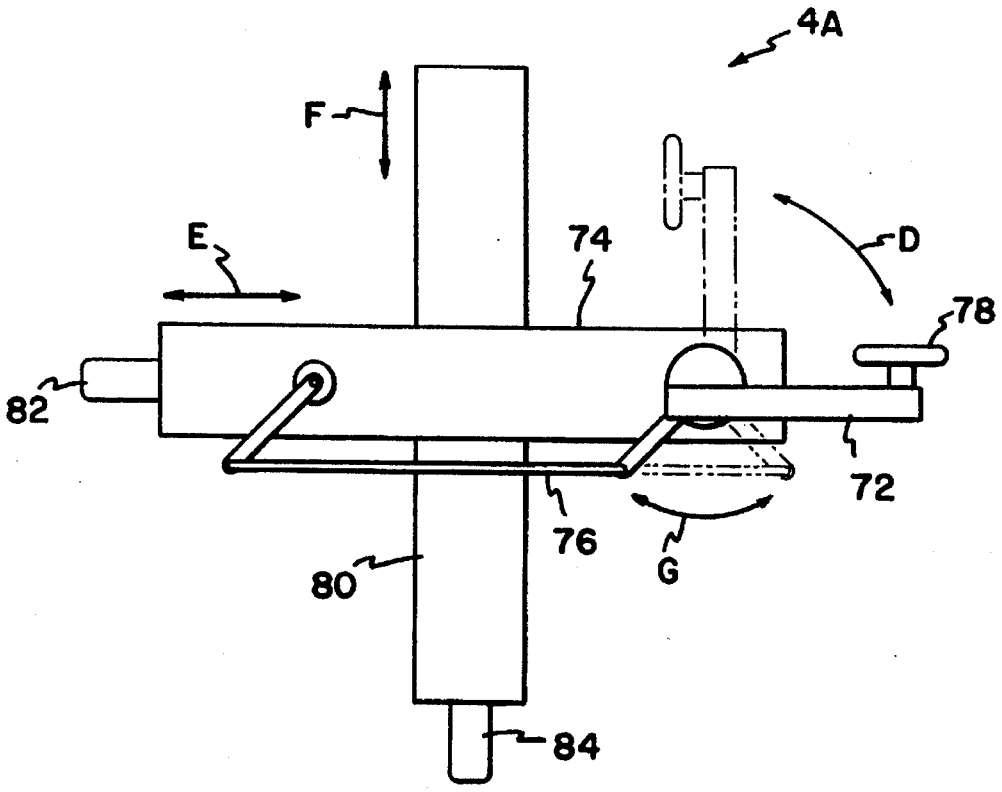
FIG. 15 is a top elevation view of the mechanism for positioning the forming roller of the preferred embodiment of the apparatus of FIG. 1.
Figure 16:
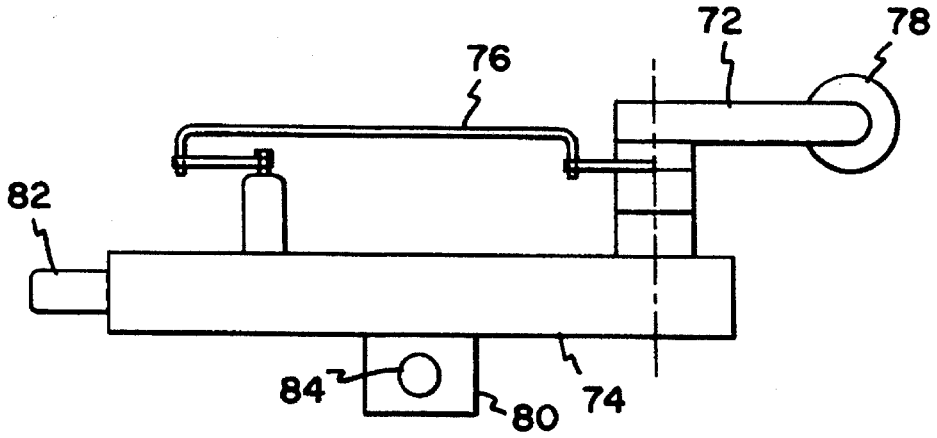
FIG. 16 is a side elevation view of the mechanism of FIG. 15.

Referring again to FIG. 1, a pair of forming rolling means 6,8 are provided for applying pressure on the outer surface of the tube 7. Each of the forming rolling means 6,8 has a forming roller rotatably mounted on a shaft which, in turn, is rigidly affixed to a roller support arm. Referring also to FIGS. 15 and 16 and considering forming rolling means 6 as example, the roller support arm 72 is pivotally mounted on a first carriage 74. An actuating link 76 (movable along arrow G) is provided on the first carriage 74 to move the forming roller support arm 72 pivotally (shown by arrow D) on the first carriage so that the forming roller support arm sweeps on a plane that is perpendicular to the vertical axis (i.e., parallel to the axis of tube).

The first carriage 74 is movably mounted on a second carriage 80 so that the first carriage can be actuated by a motor 82 to move relative to the second carriage in a direction parallel to the rotational axis of the tube (shown by arrowed line E). In turn, the second carriage 80 is movably mounted on the foundation so that when it is actuated by a second motor 84, it moves along the foundation in a direction perpendicular to the rotational axis of the tube (shown by arrowed line F). The movement of the first carriage 74, second carriage 80, and the forming roller support arm 72 relative to each other enables the forming roller 78 to be positioned precisely on the outer surface of the tube, even as the end portion 37 of the tube changes from a cylindrical shape to a constricted configuration with an arcuate surface. In this manner, the form rolling means can be controlled precisely, for example, by computer, to apply pressure on the end portion of the tube to form a desired arcuate-walled portion. It is to be understood that the carriages and the link can be arrange in other ways (for example, in a nonperpendicular relationship) to provide two dimensional movement with three degrees of freedom for the forming rollers.

Preferably, the two form rolling means 6, 8 each can perform two functions-rounding and constricting. The forming roller can be positioned on the outer surface of the end portion 37 of the tube and moved axially at a fixed radial distance from the tube axis as the tube is inductively heated and spun. In this manner, any out-of-round (i.e., non-cylindrical) imperfection of the tube can be rounded as the tube is spun and pressure is applied by the forming roller thereon. After the end portion 37 of the tube is rounded in such a manner, it can then be constricted by further actuating the form rolling means 6 (or 8) to move the forming roller 78 in successive paths between proximal and distal, radially inward and radially outward end points relative to the tube.

In alternative embodiments, a first forming rolling means can be used for rounding the tube before forming the arcuate-walled portion with a separate forming rolling means.

USE OF THE APPARATUS

In use, the preferred embodiment illustrative of the apparatus of the present invention, as shown in FIG. 1, applies pressure on an end portion of a tube along successive lines of contact as the end portion is heated, preferably by induction. Preferably, each line of contact has a straight portion. By moving the forming rolling means to apply pressure on the end portion of the tube through such successive lines of contact, the end portion can be progressively constricted to form an arcuate-walled portion. In this way, the ends of the tube can be constricted to form an opening narrower than the end of the unconstricted tube or to form a completely closed end on the tube.

Figure 18:
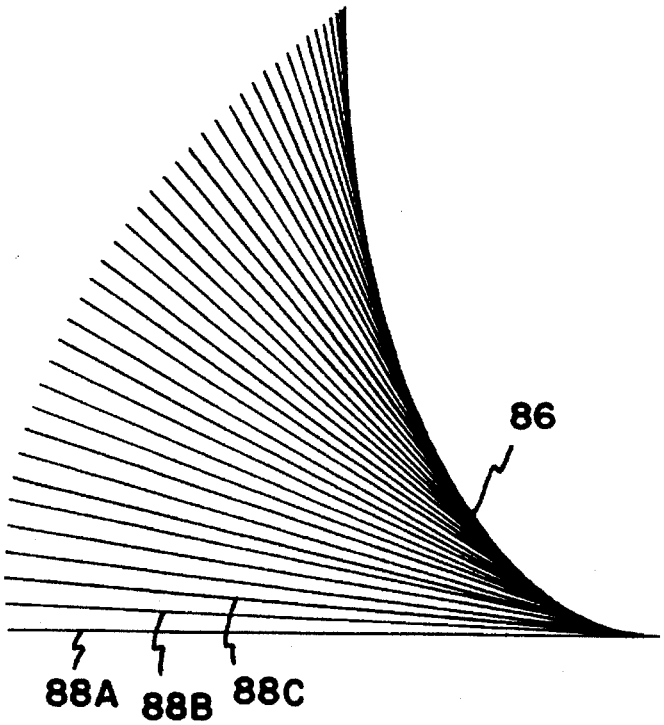
FIG. 18 is a schematic view showing the successive lines of contact of the forming roller with the end portion of the tube in the preferred embodiment of the apparatus of FIG. 1.
Figure 17:
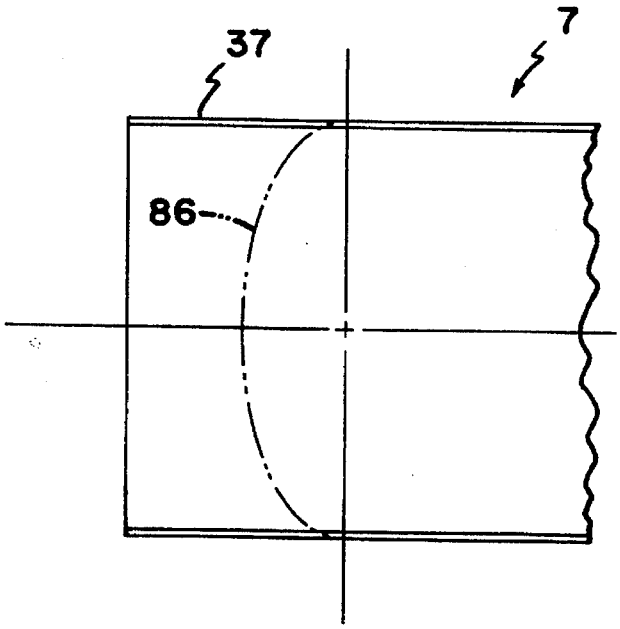
FIG. 17 is a schematic view showing the end portion of a tube and showing the shape of the arcuate portion to be formed thereon.

Referring to FIGS. 17 and 18, the present invention is particularly well-suited for constricting the end portion of a thin-walled tube with a large diameter to thickness ratio (D/t ratio) (e.g., D/t of greater than 50:1). For example, the end of the tube can be constricted to form an arcuate-walled closed end (shown by curve 86).

Referring to FIG. 18, the end portion of the tube is heated and pressure applied thereto for forming the arcuate-walled portion. Preferably, the pressure is applied along successive lines of contact 88A,88B,88C etc., each of which has a straight portion tangential to the target arcuate-walled portion 86 (i.e. the shape designed). Furthermore, these straight portions are each distal to the point at which it forms a tangent with the arcuate-walled portion. Therefore, as the arcuate-walled portion 86 is gradually formed, the locations at which inductive heat and pressure are applied gradually shift radially inward and distally along the arcuate shape of the arcuate-walled portion. As the arcuate portion is gradually formed, the part of the end portion that has not yet been shaped into an arcuate shape forms a conical configuration. The arcuate, particularly tube-segment-shaped heating element facilitates positioning the heating element in close proximity of the conical part of the end portion.

Figure 19:
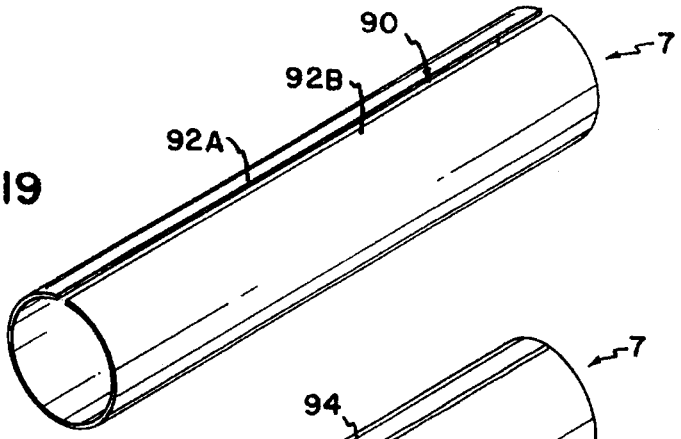
FIG. 19 shows a cylindrical structure formed by rolling a rectangular sheet of metal.
Figure 20:
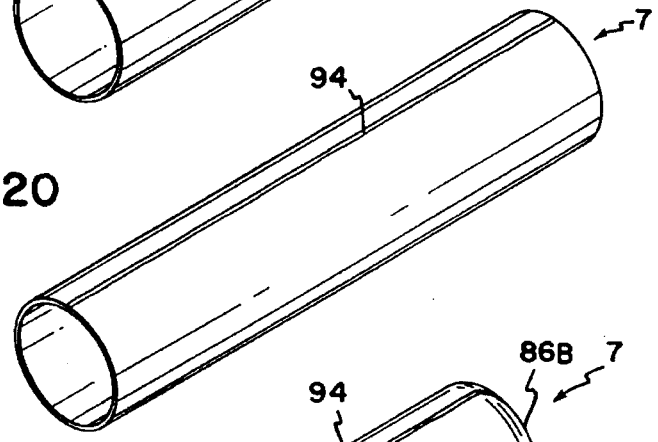
FIG. 20 shows a tube appropriate to be worked by an apparatus of the present invention, wherein the tube has a welded seam.
Figure 21A:
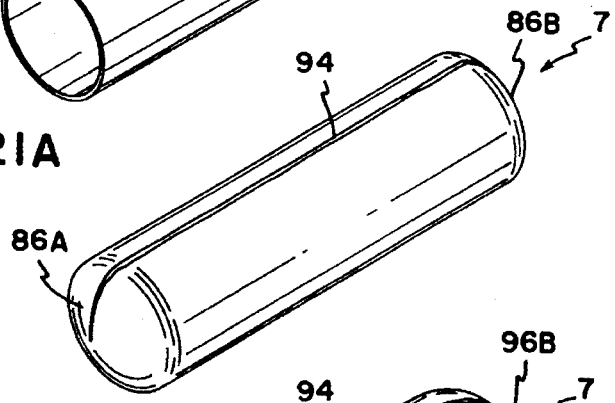
FIG. 21A shows a tank formed by constricting the ends of a tube by utilizing an apparatus of the present invention.
Figure 21B:
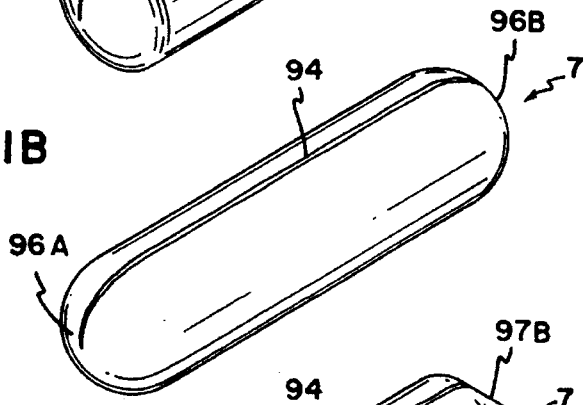
FIG. 21B shows another tank having arcuate-walled ends formed by an apparatus of the present invention.
Figure 22:
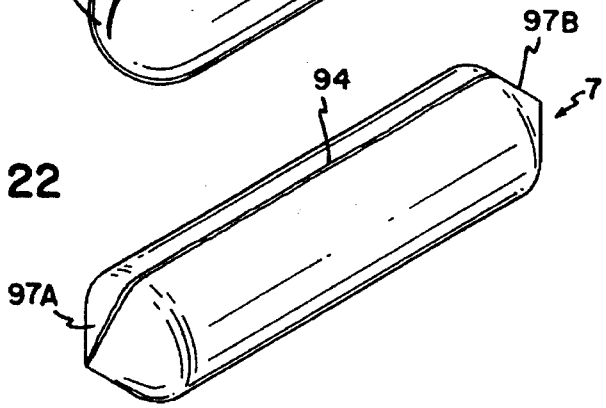
FIG. 22 shows another tank having conical ends formed by an apparatus of the present invention.

Referring now to FIG. 19, the tube (i.e., the tube to be used for forming a constricted end) can be manufactured by rolling a metallic sheet into a generally cylindrically shape. The resulting cylindrical structure has a joint (or unconnected seam) 90 where the two edges 92A,92B of the metal sheet meet. A welded seam 94 can be sealed by welding along joint 90 (as shown in FIG. 20). By using the method and apparatus of the present invention, one or both ends of the tube can be constricted, for example, closed to form arcuate-walled portions 86A,86B in an elliptical shape (as shown in FIG. 21A). The curvature of the arcuate-walled portion can be varied by modifying the locations and angles of the successive lines of contact. An example of a tank having relatively round (hemispherical) ends 96A,96B can be formed according to the present invention, as shown in FIG. 21B. A tank having conical ends 97A, 97B (as in FIG. 22) can also be made with the apparatus and method of the present invention.

In operation, a tube 7 to be constricted at an end thereof is extended through and secured to the guide ring 10. The second support bar 30 (see FIG. 7) is forced against a surface of the tube by screwing the radially adjustable threaded shafts 34A etc. into the guide ring. In this way, the tube is securely confined in the guide ring so that the tube will rotate with the guide ring. The tube rotates with the guide ring (on the same axis of rotation) as the guide ring is rotated by the actuation of the drive wheel 18 in contact with the knurled surface of the guide ring.

Referring to FIG. 1, the end portion 37 of the tube 7 on which an arcuate-walled portion is to be formed is heated, preferably, by the inductive heating mechanism. The tube is rotated as the end portion thereof is heated. The forming roller 78 is moved axially in a direction parallel to the axis of the spinning tube at a predetermined radial distance therefrom to round the end portion of the tube as previously described.

Subsequently, as inductive heat is applied to a part of end portion 37 of the tube at a predetermined distance from the end thereof, pressure is applied to the end portion of the tube as the tube is rotated. The forming roller 78 is moved along a first line of contact. The first line of contact that is not parallel to the original tube wall has a straight portion whose junction with the original tube forms a slight curvature (i.e. an angle) with the cylindrical wall of the tube. Forming along the line of contact results in a conical portion toward the free edge of the tube. That straight portion is preferably generally tangential to the curvature at said junction. It is to be understood that this tangential phenomenon is macroscopical when the resulting arcuate portion of the finished product is taken as a whole. Microscopically, if each pass is taken individually, the straight portion may not be absolutely tangent to the arcuate portion.

Figure 23A:
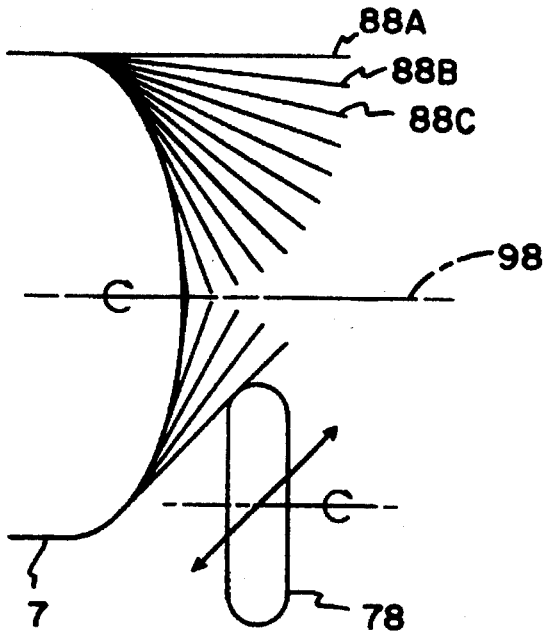
FIG. 23A is a longitudinal cross-sectional view showing the orientation and paths of travel of the forming roller relative to the end portion of the tube, wherein the rotational axis of the forming roller is parallel to the rotational axis of the tube.
Figure 23B:
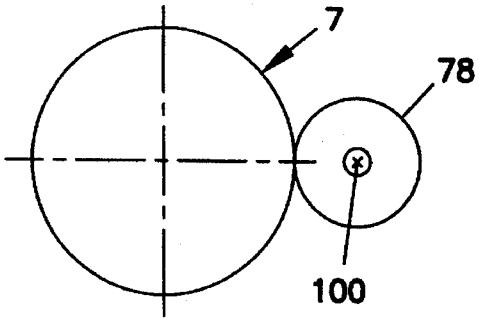
FIG. 23B is a cross-section view perpendicular to the tube rotational axis of the embodiment of FIG. 23A.
Figure 23C:
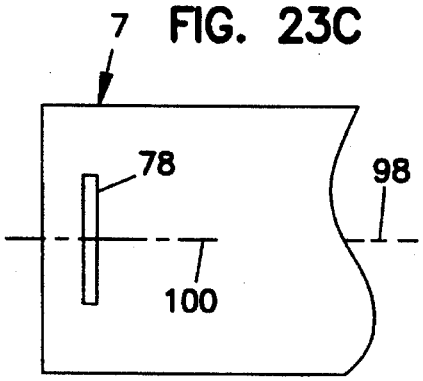
FIG. 23C is a side view of the embodiment of FIG. 23A.

Referring to FIGS. 23A–C, which shows a forming roller having a rotational axis parallel to that of the tube, the lines of contact 88A,88B,88C etc. are not defined on the surface of the cylindrical tube or the surface of the forming roller, but rather are defined as a spatial relationship with the rotational axis 98 of the tube 7. In the embodiment of FIGS. 23A–C, the forming roller 78 has a rotational axis that is parallel to the rotational axis of the tube. The forming roller 78 is moved along a line of contact (e.g. 88B) radially inward and distally toward ends of the tube from a predetermined starting end point to a predetermined ending end point.

After the forming roller has traveled to the end of a first line of contact (e.g. 88B), it is moved radially inward and then brought back along the second (i.e., the next) line of contact (e.g. 88C) to a position slightly distal and radially inward relative to the proximal starting point of the first line of contact. The second line of contact is selected so that the end point thereof remote from the free edge of the end portion is on the arcuate portion of the target shape and is radially inward and distal relative to the corresponding end point of the first line of contact. Similar to the first line of contact, the second line of contact also has a straight portion that is generally tangential to the arcuate shape to be formed (i.e. the target shape).

Furthermore, as the arcuate shape is being formed, the heating elements of the heating mechanism is moved in coordination with the movement of the forming roller so that the inductive heating coil remains proximate to the surface of the end portion of the tube. Preferably, for each successive line of contact, the heating elements of the inductive heating mechanism is moved so that the inductive heating coil moves progressively radially inward and distally so that the portion being heated moves progressively away from the location where the arcuate portion starts. The portion being heated is bounded by the then current tangent point and the free edge of the tube. In this manner, the arcuate-walled portion is formed by progressively applying pressure and inductive heat to the end portion of the tube so that the area of inductive heating and the application of pressure moves progressively away from and leaves behind a part of the arcuate portion that has been formed to the desired arcuate shape in the process.

If preferred, a tube with a conical end (as in FIG. 22) can be made. To accomplish this, the starting tube and input parameters are selected such that when the tube is spun, the free edge of end portion which is compressed by the forming tool along the straight portions of the lines of contact meet to form a fused end.

Figure 24A:
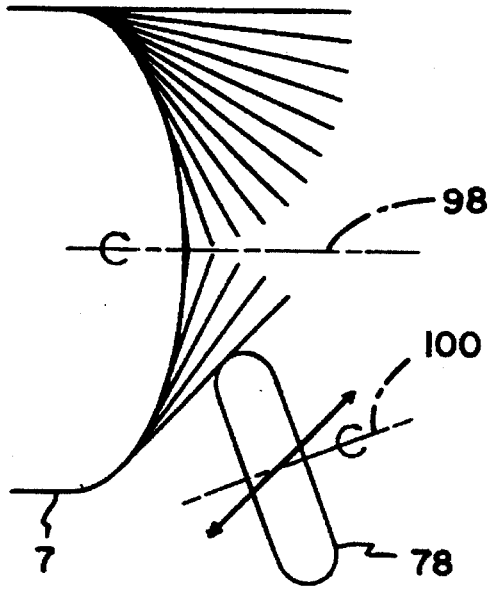
FIG. 24A is a longitudinal cross-sectional view showing yet another embodiment of the orientation and paths of travel of the forming roller relative to the end portion of the tube, wherein the rotational axis of the forming roller intersects the tube rotational axis.
Figure 24B:
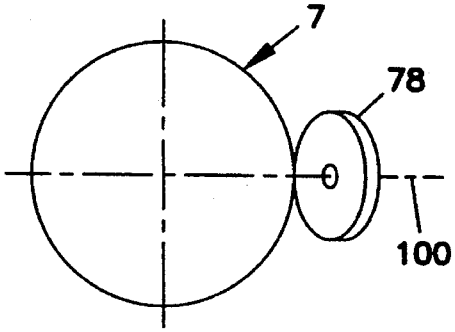
FIG. 24B is a cross-section view perpendicular to the tube rotational axis of the embodiment of FIG. 24A.
Figure 24C:
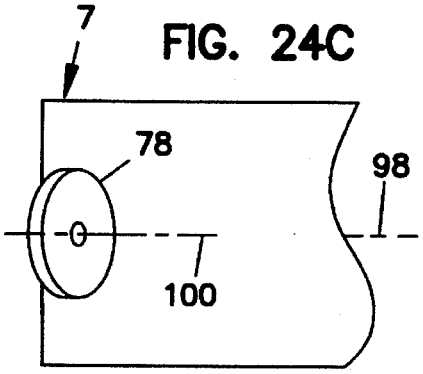
FIG. 24C is a side view of the embodiment of FIG. 24A.

As the tube is spun, because the metal in a larger diameter structure (i.e., tube) is forced into a smaller diameter structure (i.e., conical shape), the metal is forced to extend the arc length. In this manner, as the end portion of the tube is constricted, metal is continually moved towards the free edge of the tube. Based on the thickness and radius of the tube, by careful selection of optimal parameters, including those relating to the paths of travel by the forming rollers along the lines of contact, metal can be moved toward the end of the tube so that the arcuate-walled portion formed has a relatively uniform thickness similar to the thickness of the tube. Generally the thickness increase of the arcuate-walled portion is much smaller that in conventional hot spinning processes (e.g. those described by Runge). This can be accomplished by continually monitoring parameters such as temperature, force, speed of rotation of the tube for feedback controlling the orchestrated movement of the heating element and the positioning of the forming rollers. In this way, the end portion of the tube can be constricted (e.g., closed) as shown in FIGS. 23A–C. Referring to the alternate embodiment of the configuration of forming roller shown in FIGS. 24A–C, the rotational axis 100 of the forming roller 78 intersects the tube rotational axis 98 at a point distal to the forming roller.

Alternatively, the forming roller can have an axis of rotation such that it does not lie on the same plane as the axis of the tube. It is preferable that the plane of rotation of the forming roller forms a nonperpendicular angle with the straight portion of the line of contact so that the pressure applied by the forming roller on the end portion of the tube has a component that moves metal toward the free edge of the tube. Thus, in these alternative embodiments the forming roller is "skewed" relative to the tube. With a skewed configuration, the rubbing action between the end portion and the forming roller during rotation further increases the urging of metal radially inward and distally towards the free edge of the tube.

Figure 25A:
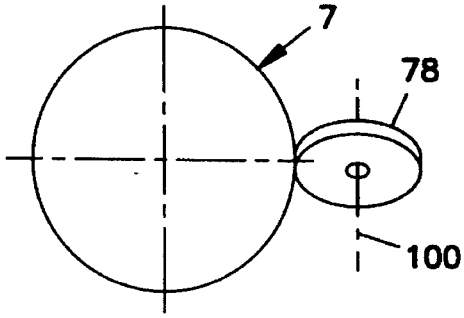
FIG. 25A is a cross-section view perpendicular to the tube rotational axis showing another alternative embodiment of the orientation and paths of travel of the forming roller relative to the end portion of the tube, wherein the rotational axis of the forming roller, although not being parallel to the tube rotational axis, does not intersect but is on a plane parallel to it.
Figure 25B:
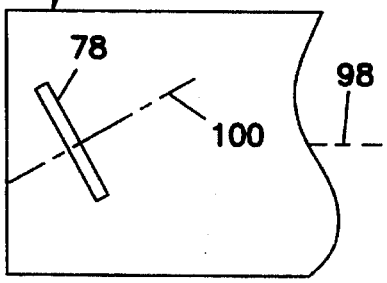
FIG. 25B is a side view of the embodiment of FIG. 25A.
Figure 26A:
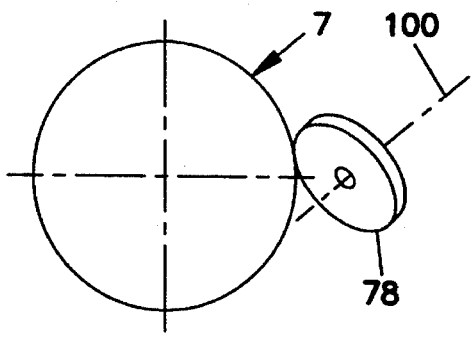
FIG. 26A is a cross-section view perpendicular to the tube rotational axis showing yet another alternative embodiment of the orientation and paths of travel of the forming roller relative to the end portion of the tube, wherein the rotational axis of the forming roller does not intersect and is on a plane not parallel to the rotational axis of the tube.
Figure 26B:
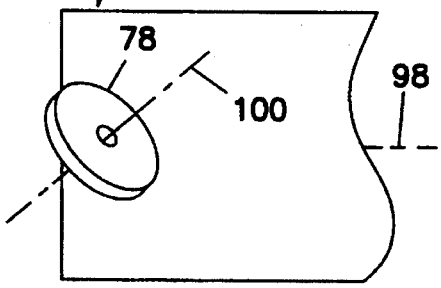
FIG. 26B is a side view of the embodiment of FIG. 25A.

For example, in the embodiment of FIGS. 25A–B, the rotational axis 100 of the forming roller is not parallel to the tube rotational axis 98. However, it is on a plane parallel to tube rotational axis 98 and therefore does not intersect axis 98. FIGS. 26A–B shows another alternative skewed embodiment. In this case, the rotational axis 100 of the forming roller 78 does not intersect tube rotational axis 98. There is also no plane parallel to the rotational axis 98 of the tube on which the roller rotational axis 100 can lie.

Figure 27:
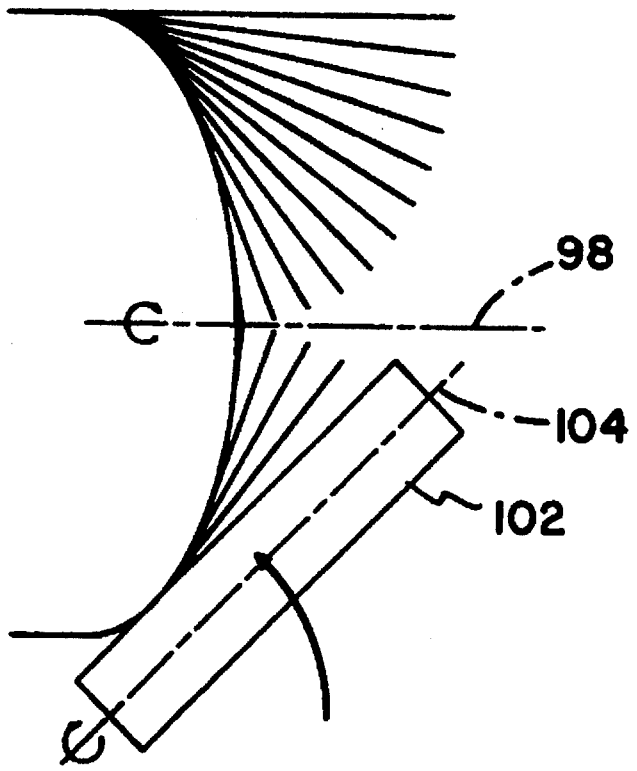
FIG. 27 is a schematic longitudinal cross-sectional view showing a further embodiment of orientation and paths of travel of the forming roller relative to the end portion of the work tube.

Referring to FIG. 27, an alternative embodiment utilizes a cylindrical rolling pin 102 for applying pressure along the line of contact. In this application, the axis 104 of rotation of the rolling pin 102 is parallel to the straight portion of the line of contact. Generally, the rolling pin 102 does not move along the straight portion of line of contact relative to the end portion of the tube. However, in the embodiments of FIGS. 23 to 26, the spacing of the successive lines of contact are adjusted by gradually and continuously moving the rolling pin proximately and radially inward in an arcuate fashion such that a substantially straight portion is more radially inward and more proximal than the straight portion of the preceding line of contact. This is accomplished with continuous motion of cylindrical rolling pin 102 in contrast to the discrete trajectories of form tool 78.

ORCHESTRATED MOVEMENT

Figure 28:
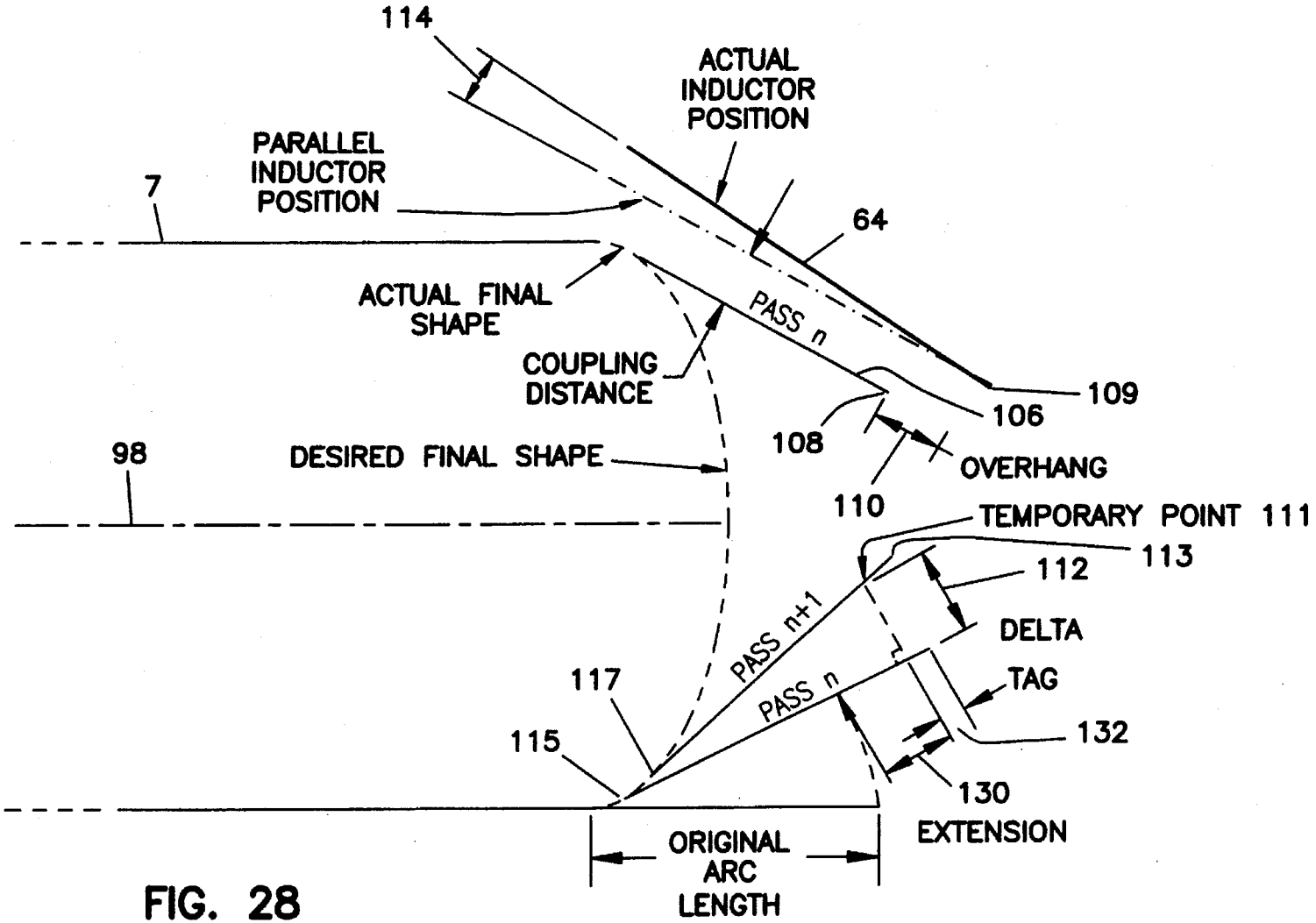
FIG. 28 is a schematic longitudinal cross-sectional representation of the positional relationship of the heating coil and the forming roller to the tube in the embodiment of FIG. 1 and showing portions of the paths of the consecutive passes of the forming roller.

As previously stated, the heating element and the forming roller are moved orchestratedly as the cylindrical structure (i.e., tube) is rotated to spin metal in the end portion of the cylindrical structure radially inward and distally. Referring to FIG. 28, the inductive heating coil 64 (or inductor) is positioned proximate to the portion of the tube 7 on which pressure is to be applied. Preferably, the heating coil 64 is rotated or positioned to be within about a half inch from the surface of that portion of the tube. To facilitate uniform distribution of heat on the end portion in which metal is to be spun, preferably the inductive coil is positioned to be slightly out of parallel (form an angle, shown as item 114, of about 4°) with the straight portion 106 towards the free edge 108 of the tube. Preferably the distal edge 109 of the inductive heating coil 64 extends past the free edge 108 of the tube to result in overhang 110. Surprisingly, the overhang and over rotation of the inductive coil, which results in a non-parallel configuration, results in a more uniform temperature distribution than otherwise (with a parallel configuration).

Figure 29A:
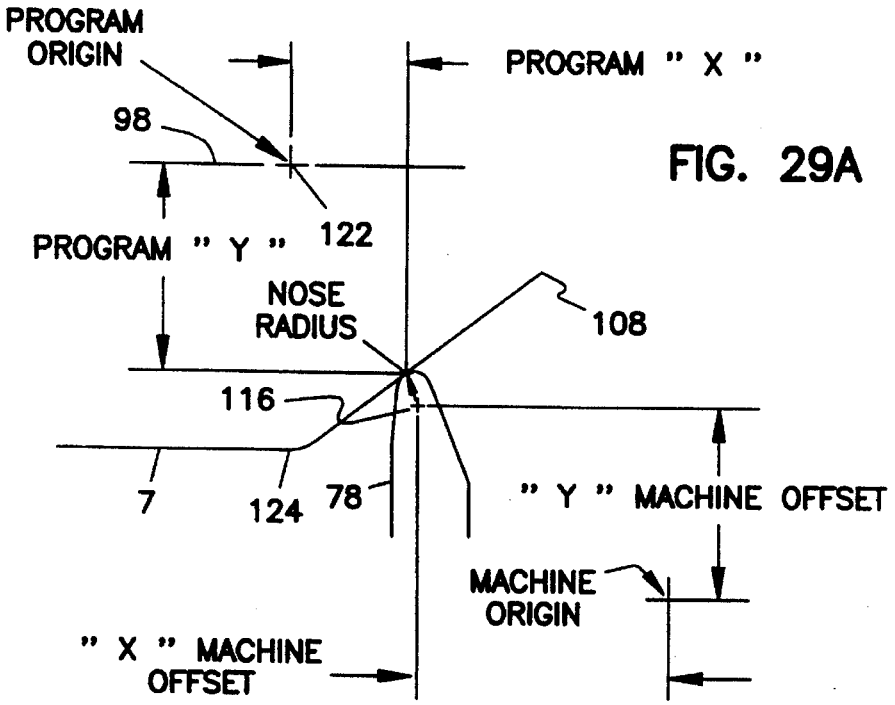
FIGS. 29A and 29B are schematic longitudinal cross-sectional views in portion showing the orientation of the forming roller and the position of the end portion in a pass of the forming roller.
Figure 29B:
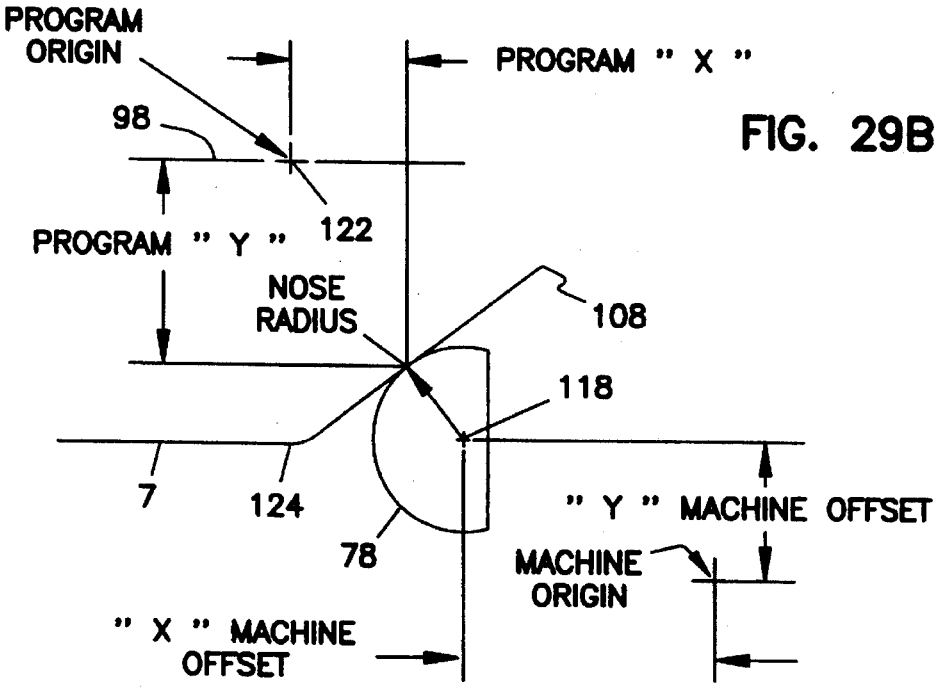

The path of the forming roller forms a tangent with the desired arcuate shape. For example, in FIG. 28, the path n is tangent to the arcuate shape at tangent point 115 and the path (n+1) is tangent to the arcuate shape at tangent point 117. Referring to FIGS. 29A and 29B, as the forming roller traverses a path contacting the tube, the position of the forming roller 78 is defined relative to a reference point proximate the forming roller's rim (or periphery) in contact with the tube. Generally for a forming roller 78 that has a contacting surface having a circular arc cross-section the reference point is at the center (116 in FIG. 29A, 118 in FIG. 29B) of the arc. In this case, the distance from the center to the circular arc is referred to as the "nose radius." However, the reference point can be arbitrarily selected as long as the position is precisely described mathematically so that the position of the forming roller can be specified.

Generally, for interfacing with the operator, as in the main program (i.e., MAIN Program) for generating the machine control program, the position of the forming roller is described relative to the tube. For example, the origin of the coordinate system (Tank Coordinate System) is the intersection point 122 of the rotational axis and a line passing through the starting point 124 of the setback and perpendicular to the rotational axis 98. To implement control, these coordinates are translated from the Tank Coordinate System into a set of coordinates defined according to a machine origin (Machine Coordinate System) based not on the tube but on the machine hardware.

The "arc length" along the surface of end portion from the point 124 where the arcuate portion starts to the free edge 108 increases with each pass. This results in an extension (130 in FIG. 28) of the end portion of the tube. As used herein, the term "extension" refers to the difference in length between the original arc length before the first pass and the arc length at the end of any given pass.

Referring to 30A–B and 31, which depict in relatively more detail portions of the paths traveled by a wheel-shaped forming roller in forming an arcuate end portion with a quarter elliptical cross section, the path of travel of a fixed point (e.g., center 116 of the semicircular arc cross-section of the periphery) of the forming roller 78 extends past the predicted free edge location (e.g., 108N) by an amount referred to as "tag" (also shown as 132 in FIG. 28). This accommodates any variance between the calculated and actual arc length. When the tube is constricted to the point approaching closure, to avoid contacting or otherwise interfering with the movement of the forming roller, instead of extending past a free edge of the tube, the inductive coil is positioned proximate the free edge with a clearance from the forming roller when the forming roller is at the tag position. As shown in FIG. 28, the tag is kept relatively constant for various lines of contact throughout the spinning operation. Generally, for a tank with a 16 inch diameter and 0.125 inch wall thickness we use a delta of about 0.15 inch and a tag of about 0.25 inch.

Referring again to FIG. 28, as the tube is rotated and the forming roller 78 (e.g., a wheel-shaped roller) is pressed against the end portion of the tube in successive passes along various lines of contact, the inductive coil is moved orchestratedly with the successive passes of the forming roller. In other words, the movement of the inductive coil lags behind the movement of the forming roller. For example, the forming roller 78 travels along path n to the free edge of the tube and then advances radially inward to a position on the n+1 pass and then subsequently travels radially outward and along path n+1 (see FIGS. 28 and 30B for detail). As the forming roller 78 completes traversing path n, the heating coil is positioned in the n position with an over-rotation (represented by 114). When the forming roller completes traversing path n+1, the heating coil is then moved to the new position n+1 with over-rotation.

Referring to FIG. 28, Delta 112 is the distance between path n+1 and n as measured perpendicular to the straight portion of path n, at the free edge of the tube. The Temporary Point 111 (which is a calculated intermediate point for estimating the arc length) for the next pass e.g. n+1, is located a distance Delta from pass n. One point 117 of the generally straight portion of the pass n+1 is then calculated so that the generally straight segment defined by this point and the Temporary Point is a tangent to the desired arcuate structure. The second point 113 is determined by extending this generally straight segment from the point 117 by an amount calculated to include the arc length, including predicted extension and the tag. Generally, the smaller the value of delta, the smoother will be the arcuate portion of the finished product. The selection of the value of delta is affected by operational constraints such as time, tube thickness, temperature and cost.

Figure 30B:
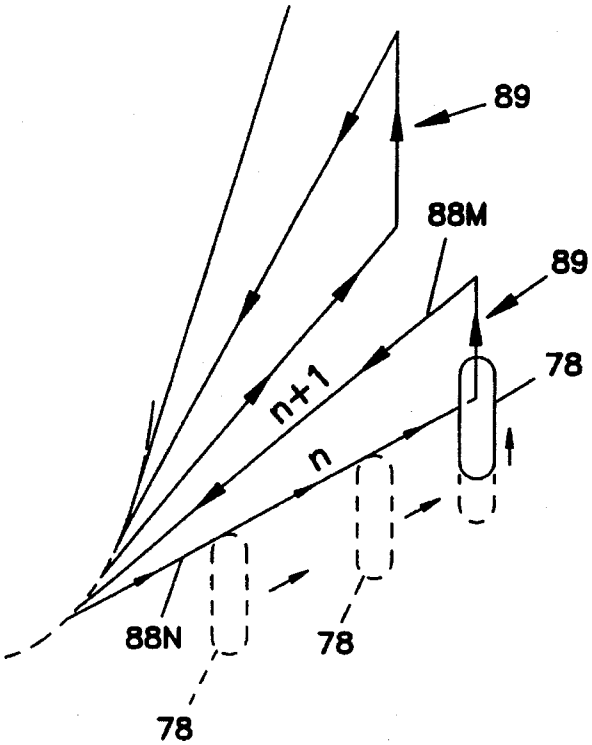
FIG. 30B is a schematic view showing (not in scale) the path traversed by the forming roller in a number of consecutive passes.

Referring to FIGS. 28 and 30B, in operation, the inductive coil 64 is moved into the position (item 64 on FIG. 28) proximate to the shape of the shell after pass n has been completed, which is immediately after the forming roller 78 has departed from path n (shown by 88N). As previously stated, preferably, the inductive coil 64 extends past the free end of the end portion of the tube to create an overhang 110 so that the whole length of the tube along which the forming roller travels can be inductively heated. This facilitates the spinning of metal by the forming roller along the lines of contact near the free edge 108 of the tube.

In the alternative case where a cylindrical roller (i.e., a rolling pin type roller) is used, the cylindrical roller is moved radially inward in an arcuate, sweeping fashion as a continuum. In this case, the free edge of the end portion of the tube is moved continuously and delta can be expressed in units of length/time. Also in this case the induction heating means can move continuously, in an orchestrated manner.

CONTROL OF THE APPARATUS

Figure 32A:
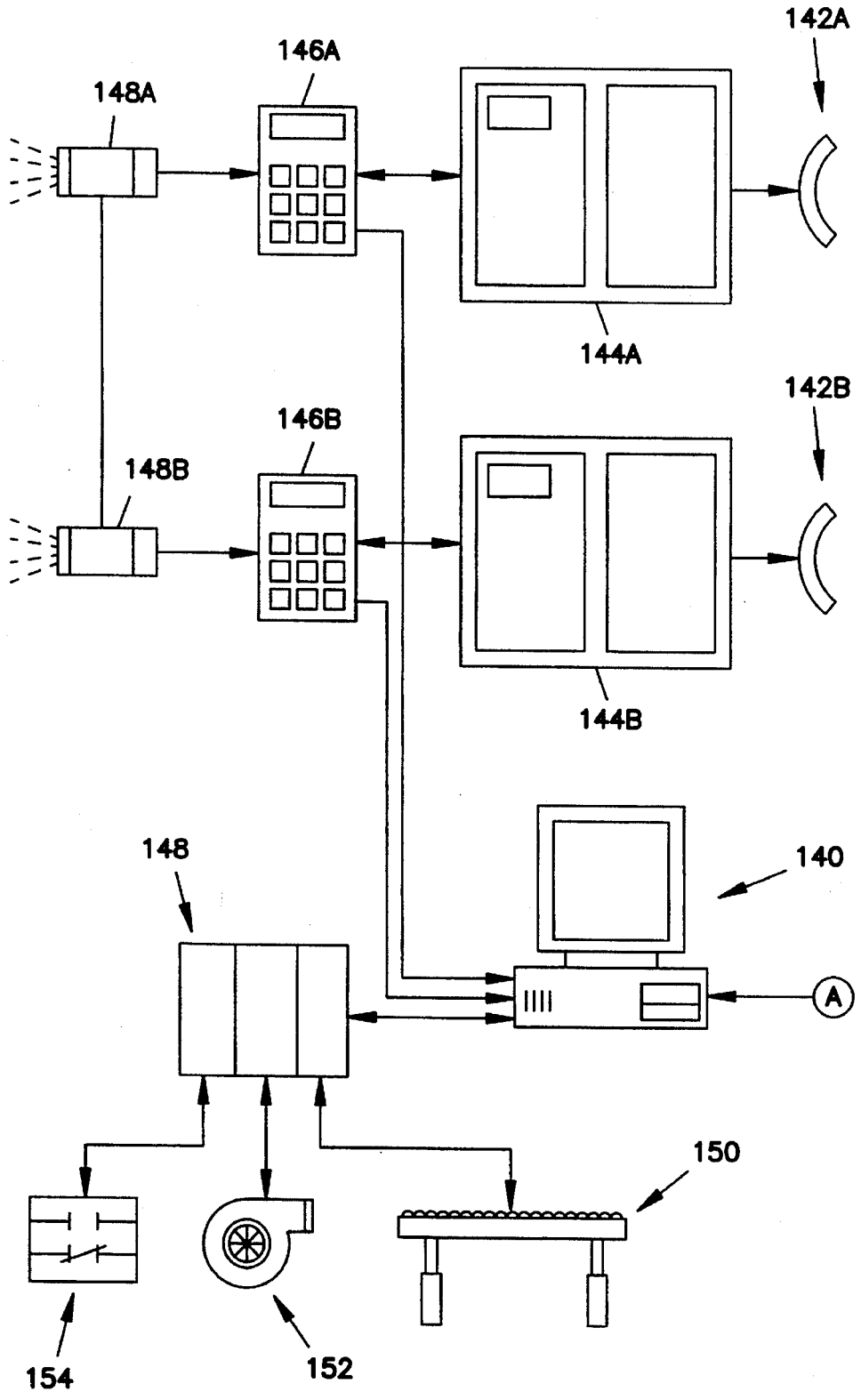
FIGS. 32A and 32B are schematic representations of the control system of the apparatus of FIG. 1.
Figure 32B:
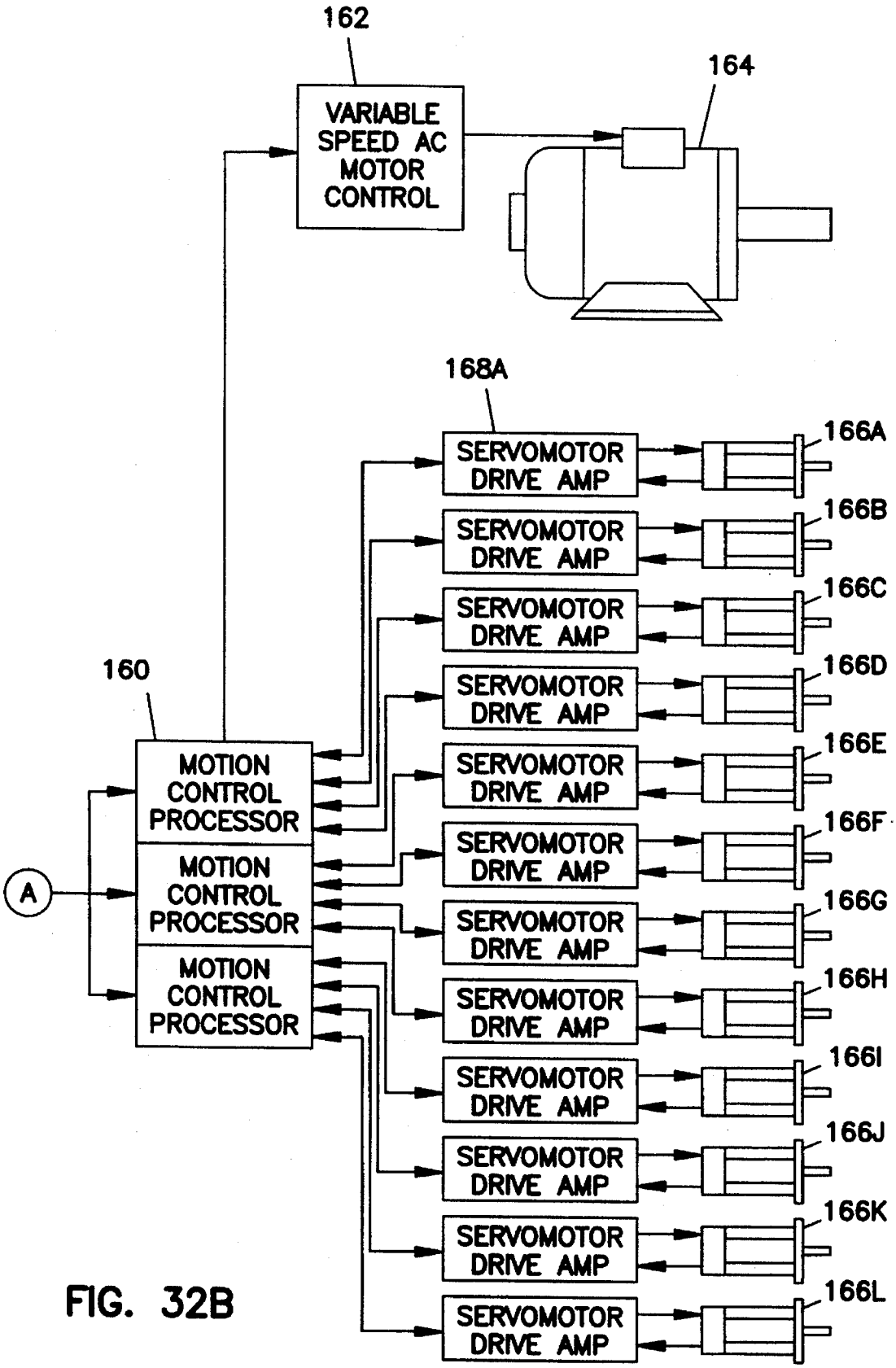

As previously stated, the apparatus of the present invention can be automatically controlled. Referring to FIGS. 32A and 32B, the control system of the preferred embodiment of the apparatus comprises a main control system that coordinates the overall operation of the apparatus, including material handling, cooling, inductive heating, and rotation of the tube. In this illustrative, preferred embodiment, information is communicated between the main control CPU (Central Processing Unit) 140 and the heating means. Two sets of inductive heating coils 142A, 142B (a left side heating coil 142A and a right side heating coil 142B corresponding to the two ends of the tube) are each powered by an induction heating power supply 144A, 144B. In each set, information is communicated between the inductive heating power supply 144A, 144B and a PID (proportional-integral-differential) temperature control 146A, 146B for controlling the power supplied to the inductive heating coil. In turn, data collected by a non-contact temperature sensor 148A, 148B is communicated to the PID temperature control 146A, 146B. Information is also communicated between the PID temperature control 146A, 146B and the main control CPU 140 for overall control of the energy output by the heating coil 142A, 142B.

Programmable logic controllers 148 (PLC) are used for controlling material handling components 150, the cooling system 152, and miscellaneous I/O components 154. Information is communicated between these various systems, components, the programmable logic controllers 148, and the main control CPU 140.

The rotational operation for spinning the tube is controlled by a motion control processor 160 which controls a variable speed AC motor control 162. The AC motor control 162 in turn communicates with a tank drive main spindle motor 164 (the motor for driving the guide ring). In turn, the motion control processor 160 communicates with the main control CPU 140. In FIG. 32B, point A (circled A) represents a connecting point between the CPU 140 and a motion control processor. A plurality of motors 166A–L drive the movement of the heating coil and the forming roller. Each of the motors 166A–L communicates with a servo-motor drive amplifier 168A, etc. which in turn communicates with its corresponding motion control processor 160. In turn, the motion control processors 160 communicate with the main control CPU 140 to provide movement of various features of the apparatus. The motors that are controlled in this manner include left forming tool (i.e. forming roller) linear axis no. 1 motor 166A, left forming tool linear axis no. 2 motor 166B, left forming tool rotary axis motor 166C, right forming tool linear axis no. 1 motor 166D, right forming tool linear axis no. 2 motor 166E, right forming tool rotary axis motor 166F, left heating coil rotary axis no. 1 motor 166G, left heating coil linear axis motor 166H, Left heating coil rotary axis no. 2 motor 166I, right heating coil rotary axis no. 1 motor 166J, right heating coil linear axis motor 166K, and right heating coil rotary axis no. 2 motor 166L.

Figure 33A:
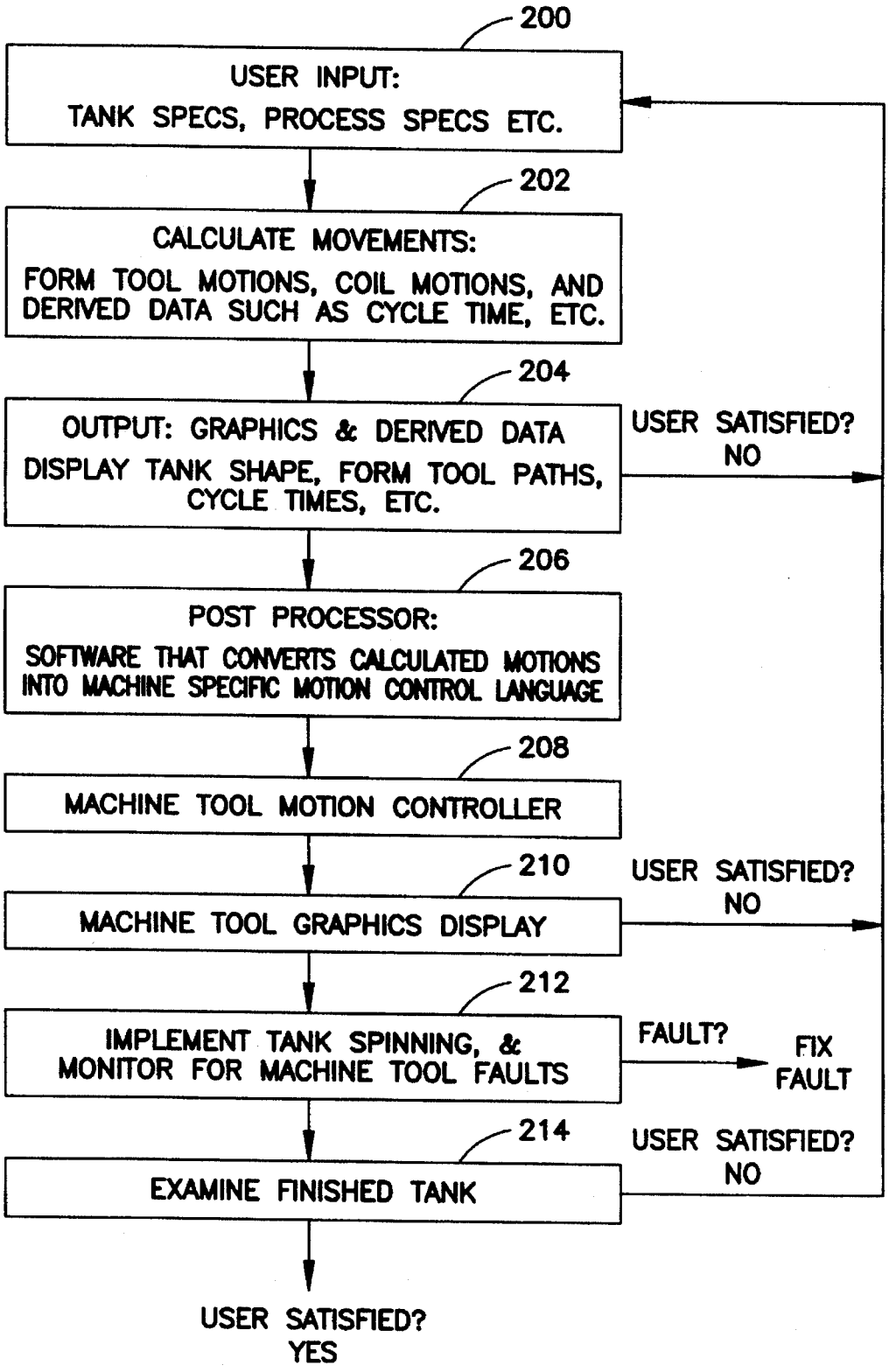
FIGS. 33A and 33B are schematic flow representations of the operation of the apparatus of FIG. 1.
Figure 33B:
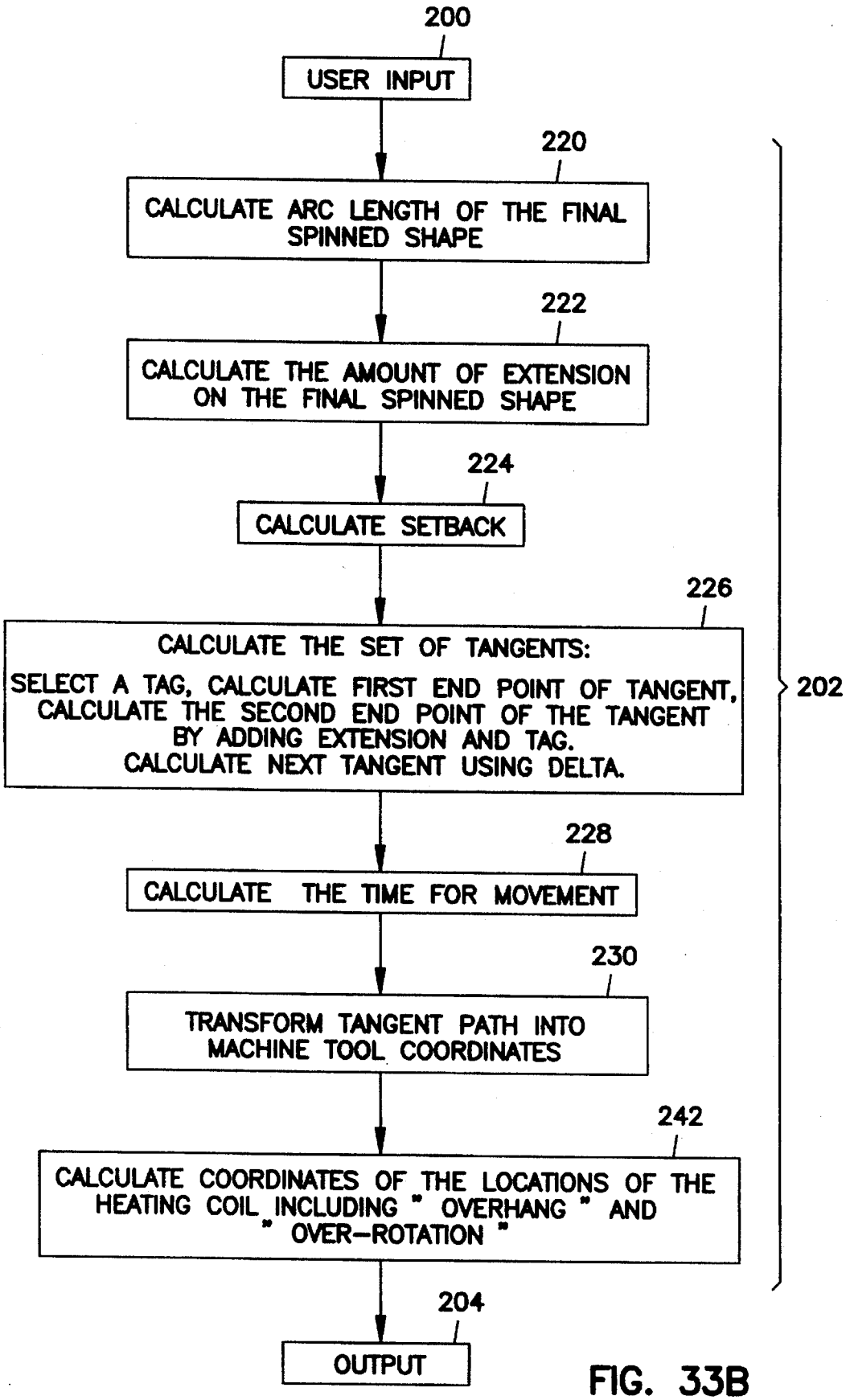

Referring to FIGS. 33A and 33B, when the apparatus is to be used for constricting the end portion of a tube, the user (operator) inputs information into the control system (i.e., main control CPU). Block 200 represents the input step. The information includes specifications of the tank to be formed (such as the diameter and thickness of the tube, the shape and dimension of the arcuate portion of the finished tank, the thickness of that arcuate portion, the original length and position of the end portion to be worked on, etc.), and process specifications (including the temperature to which the tube is to be heated, the force limits to be applied by the forming roller on the tube, the speed of rotation of the tube, etc.). Furthermore, the type of forming tool to be used is also specified. Based on the information entered, the central control CPU calculates movement by various components of the apparatus for forming the desired tank (the calculation step is represented by block 202). If a wheel-shaped forming roller is to be used, based on the value of delta specified, a set of intermediate tank shapes are calculated. Similarly, if a rolling pin type of cylindrical forming tool is used, although the cylindrical forming tool is moved in a continuum, based on delta, the intermediate tank shapes at discrete time intervals can be calculated. A set of mathematical equations is used for calculating the forming tool positions and motion as well as the inductive coil positions and motion. From the calculated positions and motions of the forming tool and the inductive coil, positions of interference of the forming tool and the inductive coil are predicted by calculation and accordingly prevented by modifying the coil position.

Further information such as total cycle time and the number of passes necessary for forming the final shape is also calculated. The information on the predicted performance of the process is then displayed, together with the user input on a display unit (e.g., a printout, plot, or display on a CRT screen). As shown by block 204, the user, based on the display information, determines if further modification of input parameters is necessary and modifies the input accordingly. The software in operation converts the calculated value on motion into machine specific motion control language for controlling the various components of the apparatus through various machine motion controllers (blocks 206, 208). If the user is satisfied with the predicted result, the user loads the program into the main CPU.

Information from the machine tool motion controller is relayed to a corresponding machine tool graphics display to be observed by the user (block 210). If the user is not satisfied with the results so far, the user can further modify the input information to change the process.

At this point, the user actuates the tank spinning process (including heating, rotation of the tube, and orchestrated movement of the heating means and the forming roller(s)) is implemented (block 212). As the process is being monitored, if a machine fault is detected, the process is interrupted and the user is given the opportunity to correct the fault. The process may then be continued until the final product, a tank with arcuate portions at the ends thereof is obtained (block 214). Based on the final product, if desired, the input parameters can be modified further to result in a better product (or a product with a different geometry) in the next operation.

It is to be understood that the sequence of the iteration of parameter input, display and converting to motion control language is flexible. For example, the input of parameters, calculation, and display of calculated information can be repeated until the operator is satisfied before the information is converted to motion control language. Alternative, the conversion into motion control language can follow every change of parameter and calculation.

The whole process of entering input parameters, calculating the movement of the heating means and the forming tools, converting into motion control language, and implementing the spinning process to restrict a tube can be done on a single computer. In this case, the means for transferring the calculated information to the means that control the heating means and the forming tool can simply be I/O ports, electrical cables, and related equipment. Alternatively, the input of parameters, calculating the movement, and converting to motion control language can be done in a computer and the information can be subsequently transferred to a second computer for implementing the spinning process. This can be accomplished, for example, by downloading the motion control language information from the first computer into a disk and then transfer the information to the implementing second computer by loading thereinto the information from the disk for operating the forming tool and the heating means. Another example is to network the two computers so that the calculated and converted information can be electronically transferred from the first computer to the second computer.

Software

The software used in the apparatus of the present invention utilizes input parameters and calculates the positions and motion of the heating means and the form rolling tool. The input parameters are entered into the computer system by means of conventional equipment, e.g. keyboard, pointer device (mouse), touch screen, and the like. The input parameters, as well as the calculated parameters are displayed, preferably on a CRT screen for an operator to review and modify. The computer also uses conventional electronic equipment for communicating information to means that drive the heating means and the forming tool.

Software—Input Parameters

As previously stated, the software utilizes input data to calculate and direct the spinning operation. Typical parameters (or data) that can be inputted include the following:

a) Number of Tanks to Make b) Shell Outside Diameter c) Shell Material Thickness d) Desired Overall Tank Length (1) This is the dimension of the finished length from one extreme end to the other, as measured along the axis of the tank. Note that as spinning progresses, generally the arc length increases and the overall length decreases.

e) Desired Geometric End Shape (1) Opening diameter if any.

(2) Desired shape of either end (with or without holes, joggles, etc.), ends may differ.

(a) Hemispherical (b) Semi-elliptical (c) Conical (d) Toriconical (e) Torospherical (f) Combined shapes (g) Special features: Rounded shells (i.e., truing of the shell), offsets, etc.

(h) Non-concentric shapes (i) User specified arbitrary shapes f) Coil Dimensions (1) Width of coil and any other dimensions that may affect interactions/interference of the coil with surrounding components of the apparatus.

g) Form Tool Shape (1) Dimensions defining the form tool shape are used in determining trajectory data.

h) Coil Coupling Distance (1) The separation distance between the coil and the surface to be heated to achieve optimum energy transfer while maintaining adequate separation to accommodate (avoid collision or arcing) any irregularities or out of roundness of the shell. See FIG. 28.

i) Coil Over Rotation (1) We have found that if the coil is placed parallel to the surface of the portion of the shell being formed, there may be nonuniform distribution of temperature. Slight rotation of the coil relative to this surface generally allows for reasonably uniform temperature distribution. This slight angular variance is referred to as "coil over-rotation." See FIG. 28.

j) Coil Overhang (1) This dimension describes an extension of the surface of the coil beyond the free edge of the surface of the shell, measured parallel to the surface being heated. We have found that some extension is required to maintain uniform temperature at the free edge of the shell. See FIG. 28.

k) Coil—Form Tool Separation Distance (1) This is the minimum allowable distance to avoid physical contact or electrical interference to accommodate any margin of error within the positioning apparatus. This situation may occur just prior to completion of the process.

l) Tag (1) This is an incremental distance added to the calculated trajectory path to accommodate any subtle variations in the actual intermediate lengths of the shell, as compared to the predicted length. Such variations may occur due to slight temperature differences, thickness variations, etc.

m) Delta (1) This is a measure of separation between successive passes. Delta is measured perpendicular to the current pass direction, at the predicted location of the free edge of the shell. Taking Delta as a vector added to this location, the new location lies on the next pass. A tangent to the shell, that passes through this new location, defines the direction of the next pass.

n) Feed Rates (1) This is the desired velocity of the form tool along its path.

o) Shell RPM (1) This is the rotational speed of the shell in cycles per minute.

p) Temperature Range (1) We specify a range because we have found that tanks may wrinkle easily if the temperature is too low, and they may fail structurally if the temperature is too high.

Software—Derived Process Variables

Based on the input data, the software calculates required motions and associated derived process parameters:

a) Calculate Setback/length of shell needed based on arc length extension:

The overall length of the shell shortens during the spinning process. However, the arc length of the shell, which is the length as measured along the surface of the shell, increases. The increase in arc length is called shell "extension" (See FIG. 28. In FIG. 28, the "Original Length" is that length which when increased by the cumulative "extension" amount is just equal to the required arc length for the desired end shape.) We have found that a simple power law can be used to approximate the amount of arc length extension observed. We have found a reasonable approximation to be that the shell arc length extends about 0.2 times its radius for a fully closed elliptical head. The arc length extension for intermediate shapes can be estimated to be proportional to: Constant×radius×(((angle in rads)*$(2/\pi))^P$), where radius is the radius of the original tube and angle is the angle between the rotational axis and the tangent. The angle is zero for an open shell and is $\pi/2$ for a closed end, and P ranges from 0.5 to 1.0. The value of the Constant is approximately 0.2, but changes slightly with temperature, end shape, and material thickness. The initial shell length required is just the desired length between the knuckles, plus the arc length of the shape of the ends, less the calculated shell arc length extension of both ends.

b) Calculate Form Tool Trajectories.

(1) Calculate Form Tool Trajectories: Based on trigonometry, the trajectories of the form tool are calculated. (A contacting trajectory is just any motion which is expected to be a major spinning motion, i.e., contacts the shell in a manner sufficient to cause the shell to change shape.) We add an additional length called the Tag (typically 0.25 inches) to the calculated trajectories to accommodate any error in this approximation.

(2) Calculate the transition motions: The transition motions (item 89 in FIG. 30B) to move the forming tool from the end of one contacting trajectory to the beginning of the next is calculated.

(3) Determine rpm, feeds, c) Calculate Coil Trajectories (in which the heating is orchestrated with the spinning).

(1) Calculate area to be heated.

(2) "Slaved" to forming tool.

(a) In the case of a forming roller, coil moves to the next position to heat the shell as soon as the form roll has completed the previous pass. This is what we mean when we say the coil is slaved to the form tool.

(b) In the case of a forming pin (FIG. 27), the coil will move continuously, as the shell changes shape.

(c) If by moving to the calculated position, the coil is going to physically interfere with the form tool, then its calculated positions are modified to avoid interference.

(d) The motions of the heating coil and the form tool must be synchronized. Various motion control languages accomplish this in different ways. Often, the computer can generate synchronization points to force all the individually controlled motion axis to synchronize after a particular motion is completed. Alternatively, the motions can be orchestrated via a real time clock.

d) Calculate derived information such as total cycle time, number of passes (in the case of a forming roller), how many passes would interfere with the coil, etc.

Software—Display Graphics a) By selecting this item, the operator can selectively display the contact trajectories, forming roller center paths, forming roller center hops, forming roller at path ends, desired final shape, actual final shape, intermediate tank shapes, etc. Furthermore, centerline, tick marks and grids for showing the trajectories and paths can also be specified for display. Under the menu "Display," submenus such as redraw screen and clear screen can also be selected to redraw the display and clear the display.

Software—Post Processor

The post Processor converts the instruction to operate the apparatus to Apparatus Specific Motion Control Language:

a) Convert Dynamic information into apparatus specific motion control language.

(1) Example: generate RS 274 standard CNC (Computer Numerical Control) code for typical CNC controllers.

b) Convert Process control parameters to apparatus specific process control language.

c) Generates machine control software for motion control and PLC.

(1) Software generates software (i.e., "Program Generator" software generates machine control software—sort of a purpose built non native compiler for single or multiple processors that interact to control all process requirements).

(2) Real time modification of any of the above based on sensor feedback.

(3) Supports E return—not just E Stop. (See terms described hereinabove).

(4) Allows for spinning of almost any shape with a single form tool.

Software—Schematic Flow Representation

After entering the necessary input parameters and initiating the calculation by the computer, when the operator is satisfied with the displayed information, the operator implements the spinning process, as shown in FIGS. 33A and 33B. FIG. 33B shows in more detail the flow of the software in implementing the spinning process calculations, based on the input parameters. Referring to FIG. 33B, block 200 represents the input parameters (see block 200 in FIG. 33A). Based on the input parameters, the arc length (AL) of the desired final arcuate shape is calculated (block 220). Based on the desired final shape, the anticipated amount of extension (Ext) is calculated (block 222). Having calculated the final arc length and the extension, the setback (SB) is calculated with the equation:

$$SB=AL-\text{Ext}.$$

The setback represents the distance from the free edge of the tube where the arcuate shape of the final shape needs to start in order to achieve the desired final shape. See block 224. The set of tangents are then calculated (block 226). To specify the tangents, the start and stop points, as well as the speed of traveling of the forming tool are to be calculated. Based on the values of delta and tag specified, and an equation for calculating the local extension, the tangents for each path can be calculated. For example, the first tangent is defined by one end point at the setback position of the tube. The other end point is at a point one radius from the rotational axis of the tube and one tag distance beyond the free edge. After selecting a direction of the tangent and a speed of movement of the forming roller, the tangent is converted into machine tool coordinates. Based on the value of delta selected (i.e., input) the location of a temporary end point near the next desired free edge of the tube is calculated. Based on the desired final shape, and the temporary end point, the tangent location on the desired final shape is calculated. The final (i.e., adjusted from temporary) end point of this tangent is then calculated by taking into account the estimated local extension. A tag length is added thereto to provide the estimated straight path of the forming roller. This process of calculating tangents based on previous tangent segments is repeated until (1) the metal has been exhausted, (2) no more tangents can be calculated, i.e., the desired final shape has been formed, or (3) the estimated path of the forming roller has traveled over the tube rotational axis by an excessive amount (due to delta and tag). The movement of the reference point of forming roller corresponding to the predicted path of the forming roller traversing from one tangent to the next tangent (i.e. between forming passes) is referred to as the "forming roller center hop" (item 89 in FIG. 30B).

Based on the feed rates and directions selected for the tangents, the time for the movement of the forming roller can be estimated (block 228). The locations of the tangents are then transformed into machine tool coordinates (block 230). The location of a fixed point (e.g., the center of a form roller nose radius, 116 in FIG. 29A, 118 in FIG. 29B) relative to the tangent is calculated. Then offsets are added and scale factors are used to obtain their coordinates in the machine tool coordinate system.

The locations of the inductive heating coil (or inductor) orchestrated with the movement of the forming tool are then calculated. The cross sectional line of the inductor is located a certain distance from a tangent. The position of the inductor is mathematically extended past a free edge of the tube to a specified value of "overhang." The position of the inductor is then rotated to obtain the desired value of over-rotation (see FIG. 28).

The distance of the closest approach of the inductor to the forming tool is calculated (when the forming roller is at the ends of the tangent paths, using one tangent a head for the forming roller paths, because the coil lags the forming roller by one pass). If this distance is too small (e.g., less than 0.5 inch) the inductor is mathematically moved back along the line on which it lies so that it is at the minimum specified separation distance from the forming roller.

The input parameters and the calculated values of the position and motion of the forming tool and the inductive coil are then displayed as an output to interface with the operator (block 204), as also shown in block 204 of FIG. 33A.

Figure 31:
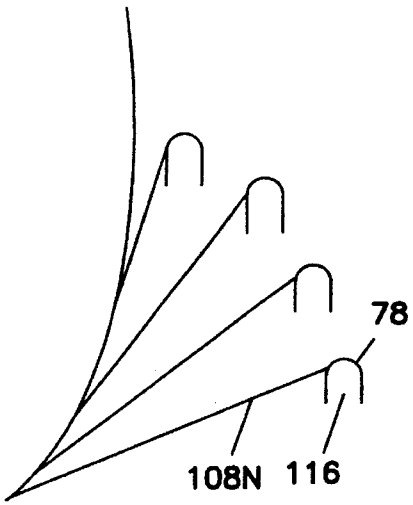
FIG. 31 is a schematic longitudinal cross-sectional view showing the relation of the position of the forming roller and the end portion of the tube in various representative passes.

Referring again to FIG. 33A, the post-processor translates the input parameters and the calculated values of positions and motion into machine control language. This post-processor also adds intermediate motions (item 89 on FIG. 30B) between the passes for the forming roller (see FIGS. 28, 30B, and 31). The heating coil locations are also transformed into machine tool (i.e., motion control) language. A feed rate is assigned to the inductive coil to move it from one position to the next. This feed rate is selected for quick movement of the coil as compared to the time the forming roller takes to traverse one tangent pass.

The orchestrated movement of the forming tool and the heating inductor coil is implemented by calculating the time to move the coil after the forming roller has completed traversing a pass. For example, when the coil is heating in position n, the forming tool is executing pass n+1. The time for the forming roller to traverse the pass n+1 is compared to the time the inductive coil is in position n and adjusted if needed. Synchronization points between passes are installed to ensure that the forming roller and the heating coil move in a orchestrated fashion. This synchronization compensates for any cumulative errors, such as round off calculation errors, errors in transition time estimates due to acceleration/deceleration variations, etc.

Software—User Interface

The apparatus and software enable an operator to input parameters for the spinning process, obtain display of the estimated (modeled) process, implement, and monitor the process. The display is preferably by means of a CRT. The software presents a pull-down menu so that the operator can specify a screen display for displaying specific information. The following is a list representing the items that can be selected from the menu:

Display
- Contact Trajectories
- Form Roll Center Path
- Form Roll Center Hops
- Form Roll at Path Ends
- Desired Final Shape
- Actual Final Shape
- Intermediate Tank Shapes
- All Coil Positions
- Non-Interfering Coil Positions
- Shell
- Centerline & Tick Marks
- Grid
- Redraw Screen
- Clear Screen Specify
- Head Geometry
- Other Geometry
- Calculate Trajectories Post
- Generate RS-274 Code File
- Print RS-274

One of the items that can be selected in the menu is "Display." By selecting this item, the operator can selectively display the contact trajectories, forming roller center paths, forming roller center hops, forming roller at path ends, desired final shape, actual final shape, intermediate tank shapes, etc. Furthermore, centerline, tick marks and grids for showing the trajectories and paths can also be specified for display. Under the menu "Display," submenus such as redraw screen and clear screen can also be selected to redraw the display and clear the display.

The menu item "Specify" can be selected to input parameters and to calculate trajectories. In this menu, submenu "Head Geometry" can be selected to specify the parameters (such as the radius of the tube, the semi minor axis for a ellipsoidal head) relating to the head, i.e., arcuate portion of the final shape. The submenu "Other Geometry" can be selected to specify other parameters (such as set back, tag, delta, tube length, and the like) relating to the geometry of the tube. The submenu "Calculate Trajectories" can be selected to mathematically calculate the estimated trajectories based on the input parameters.

The menu item "Post" can be selected to generate the machine control language code for controlling the movement of the heating means and the forming roller.

The menu item "File" can be selected to save the program, parameters, or to print out the RS-274 code.

Software—Description of Specific Software Embodiment

An embodiment illustrative of the software used for generating motions for spinning tanks is generally described as follows. In this embodiment, generally two types of software are used to spin tanks. The first package is a BASIC program which in turn automatically generates the second software package. An example of BASIC program is shown in the microfiche appendix. The second software package is written (by the first program) in RS 274 language. RS 274 is a widely used motion control language. The first program is called a "program generator." Although preferred, the use of a program generator is not absolutely essential. One can use a drafting board or a CAD program to determine key geometrical locations and manually program the RS 274 code if desired.

The software is written in a version of BASIC called Future BASIC, which has some features of C Language. The software runs on current generation MACINTOSH (or "Mac") brand of computer from Apple Computer Corp. The user interface is a typical, Mac like GUI (graphical user interface). Like most GUIs this one is driven by user interrupts via interactive concepts like menus and mouse manipulations. It is to be understood the use of other types of computers are within the scope of this invention.

The software architecture uses structured programming. The Software is directed by a MAIN program which calls subroutines, the subroutines are called "Functions" and appear in the code following Function statements which begin with the key symbol "FN". Some remarks usually follow the Function name and describe what the function does. Program control is traversed via Function calls. Functions call functions. When a function is completed, control of the program reverts to the next higher level function that called the just completed function. Many functions are called not just once, but many times. The order of the functions in the source code listing is related to convenience of programming and does not necessarily mean that a function appearing in the list following another function is executed in that order. The majority of the source code listing is function definitions. The beginning of the source code contains global variable declarations and introductory comments. Comments are denoted by key symbols: "REM" or "'" (single apostrophe). Variables have scope—i.e., they may be available to a function or may not be. In general only those variables with global scope (usually denoted with a lower case "g" as the first symbol in the variable name) or those variables defined within a function definition are available to that function. The MAIN program (or MAIN function) is 8 lines long and is located at the end of the source code listing.

The program generates results based on input data. Data can be input in two ways. The first is through hard coded values in the source code. This means that to input a new value, the source code listing is edited, recompiled, and then the edited program is run. The second way to enter data is through the GUI. This is the preferred manner, since it is fast and interactive. Several classes of users may be defined, with different sets of input data being made available to different sets of users. The first method is more versatile, since any segment of the program can be modified in this way.

The following is a list of key functions used in the MAIN program recorded in the microfiche appendix and a brief description of those functions. The MAIN Program is an illustrative source code listing. This program can be used to generate an output of RS 274 code for controlling machine movement. In the following list, the Function name is followed by a brief overview of the function. The page numbers refer to those in the listing, contained in the microfiche appendix.

MAIN: Page 41 This program calls the initialization routines, sets interrupt vectors (i.e., directs the code to transfer control to specific functions depending on what interrupt device was invoked) and sets up the main event loop to poll for interrupts.

initialize: Page 5 This function is called by the main program. It sets most of the input parameters, except for those input via the GUI. It also sets up the menus, and performs precalculations to suggest the correct setback to the user.

CalcInterference: Page 10 Tests for interference between the form tool and the heating coil. If there is interference, it creates a corrected position for the coil.

ArcLengthQuart: Page 4 Calculates the arc length of one quarter of an elliptical head.

ExtensionFunction: Page 4 Estimates how much arc length extension the shell will undergo by the time spinning is completed.

Decouple: Page 9 Calculates the desired amount of decoupling (which in turn is used to calculate over-rotation elsewhere), based on a maximum amount of decoupling at the knuckle towards the end of the spinning process. We currently use an amount based on the square of the local coil angle.

CalCoilPivot: Page 12 There are many coordinate systems and coordinate transforms to work with in a spinning machine. This function converts the information on coil surface location in the tank coordinate system to the parameters controlling the coil position, which are the X, Y, Theta values for the pivot on which the coil is mounted. (These are converted to machine coordinates elsewhere).

CalcSpinTimes: Page 13 This function calculates the duration of each move, based on the length of the move and the velocity of the move and forms an estimate of the total spinning time. This is important because the total cycle time determines how fast products can be made.

CalcTrajectories: Page 14–17 This function calculates the geometry associated with the forming tool and heating coil trajectories. The directions and velocities associated with the trajectories are calculated and installed in a data structure elsewhere (see Post). This function calculates the tangents, based on the input data including the end shape and tags, deltas, etc. The tangents referred to here are the straight portions of spinning passes referred to hereinabove.

GetGeometry, GetHeadShape, GetSpecialPlotInfo: Page 17, 18 These functions fetch the correct data from the user in response to the user selection of a menu item which represents a request by the user to input data.

ShowCenterLineTicks, ShowCoilTrajectories, ShowEllipse, ShowFormRoll, ShowGrid, ShowIntermediateShapes, ShowSequence, ShowShell, ShowTrajectories: Pages 20 thru 25, elsewhere Theses functions are called via menu selections for displaying particular aspects of the tank spinning data.

StandardCode: Page 27 This function loads the output data structure with hard coded RS 274 code required by the machine at the beginning and end of our machine control programs. The program generator software is focused on generating all of the code that goes between this hard coded information. This function is included as a matter of convenience, so that this hard coded RS 274 information does not have to be added later on.

GetMachineCoords: Page 34–37 This function converts the geometric data from the tank coordinate system into machine coordinates and also calculates distances of each pass, it is used by the Post function to set velocities.

Post: Page 30–34 This function (in conjunction with Get MachineCoords) creates the RS 274 code required by the machine controller. It outputs the code to a text file, which is easily transferred (electronically or by disk) to the machine controller computer. It should be understood that the computer on which the program generator runs and the computer which controls the machine tool could be the same computer, or different types of computers. (The use of the name "Post" here derives from the phrase "Post Processor" which is a common term for software that converts data into a machine tool specific format.)

doMenus, doMouse, doDialogs: Page 37, 40, 41 These functions trap the user's interactive input selections and call the appropriate function(s).

TrapData: Page 39 This function traps user input data from a Mac specific window called a dialog box. This is another typical way that the user can enter data.

Others: Several other functions, which would be apparent to one skilled in the art for implementing control of an apparatus using the system of the present invention, are not specifically discussed here. For example, some of these have top do with managing which CRT the plots go to on a computer system with two CRTs, others have to do with color selection, etc. The use of such functions are generally known in the art and are not described in detail herein.

EXAMPLE

Figure 30A:
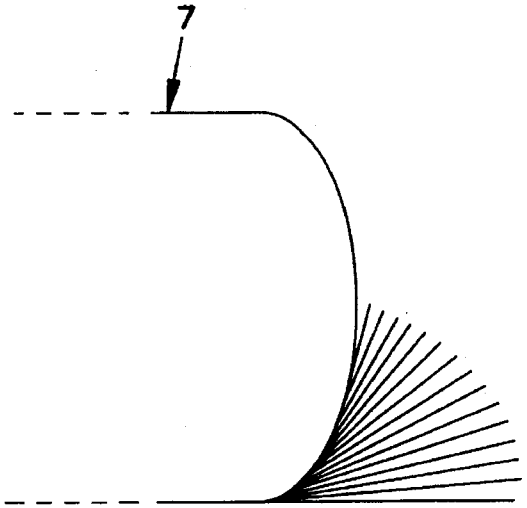
FIG. 30A is a schematic longitudinal cross-sectional view showing representative paths of the forming roller in the embodiment of FIG. 1.

A gas storage tank was made with an apparatus functionally equivalent to the preferred embodiment as shown in FIG. 1. A carbon steel tube with an outside diameter of 16 inches was made by cutting a rectangular sheet of carbon steel of a thickness of 0.125 inch with a width of 52 inches. The rectangular sheet of carbon steel was rolled into a cylindrical shape by curving the 52 inch edges into a circular shape. In this manner, the other two opposite edges abutted each other to form a seam which was welded. The resulting carbon steel tube was mounted in the apparatus. An inductive heating coil having a shape of a tube segment with a radius of 8.5 inches was positioned at the end portion of the tube with a clearance of about 0.5 inches between the heating coil and the tube. The tube was rotated and the end portion of the tube was heated to about 2100° F. (1150° C.) in about two minutes before the start of the spinning process. A wheel-shaped forming roller was applied to the end portion to round out the out-of-round irregularities before the forming roller was moved radially inward to create the arcuate portion. The arcuate portion was to have a 2:1 elliptical shape as shown in FIG. 30A. Thirty-nine passes (successive lines of contact) were used to produce the final shape. The extension for each pass was calculated using the equation $$\text{extension}=\text{Constant}\times\text{radius}\times(((\text{angle in rads})\times(2/\pi))^{p})$$

where the angle is 0 for an open end of a tube and equals $\pi/2$ for a closed end, and p ranges from 0.5 to 1. The value of Constant is approximately 0.2 but changes slightly with temperature, end shape, and material thickness. The exact values of Constant and p were determined by performing a few runs and correcting for variations from the predicted values.

The components of the apparatus were obtained from commercially available sources, as listed in the following table.

Component Selection

| | Manufacturer | Location | Model Number |
|---|---|---|---|
| Main Computer | IBM/Clone<br>Macintosh | | PC<br>Quadra 840 |
| Motion Control Cards | Delta Tau Data Systems<br>Galil Motion Controls, Inc. | Northridge, CA<br>Sunnyvale, CA | PMAC-DSP-PC<br>DMC-1000 |
| Servo Drive Amps | Reliance Electric<br>Yaskawa Electric Mfg., Inc. | Eden Prairie, MN<br>Tokyo, Japan | BRU 500<br>SGD-08A |
| Servo Motors | Reliance Electric<br>Yaskawa Electric Mfg., Inc | Eden Prairie, MN<br>Tokyo, Japan | F-4030<br>SGM-08 |
| Spindle Drive Amp | Safetronics, Inc.<br>Eaton, Corp. | Fort Meyers, FL<br>Kenosha, WI | Varispeed-616G3<br>AF 1500 |
| Spindle Motor | Leeson Electric Motors<br>Powertec Industrial Corp. | Grafton, WI<br>Rock Hill, SC | 15081<br>30 Hp TEFC |
| Non Contact Temperature Monitors | Raytek, Inc. | Santa Cruz, CA | Thermalert MP-4 |
| PID Controllers | Omron Electronics, Inc.<br>Red Lion Controls | Schaumburg, IL<br>York, PA | ES 100<br>PCU01004 |
| Induction Heating Power Supplies | IHS Inductoheat | Ft. Worth, TX | UPF6-250-3 |
| PLC | IDEC | Sunnyvale, CA | Micro-1 |

-continued

| Component Selection | | |
|---|---|---|
| Manufacturer | Location | Model Number |
| Eagle Signal Controls | Austin, TX | Micro 190 |

As previously stated, the method and apparatus of the present invention can be used to constrict the end portion of a tube. However, the present invention can be used to expand the end portion of a tube (e.g., to produce a flared end) by heating and applying pressure while rotating the tube on its axis. In this case, the forming tool is to be pressed to the inner surface of the tube rather than the outer surface. The orchestrated movement of the apparatus, heating, programming of software, implementation of the process using software, and the like, can be done in a manner similar to the above-described embodiment.

The present invention has been described in the foregoing specification. The embodiments are presented for illustrative purposes and are not to be interpreted as unduly limiting the scope of the invention. It is to be understood that modifications and alterations of the invention, especially in size and shape, will be apparent to those skilled in the art without departing from the spirit and scope of the invention. For example, the straight portions of the lines of contact can be modified to have a slight curvature.

What is claimed is:

1. An apparatus for constricting an end of a metallic tube to form an arcuate-walled portion, the apparatus comprising:

means for rotating the tube about its longitudinal axis;

a forming roller mechanism including a forming roller adapted for applying pressure to an end portion of the tube, the forming roller mechanism being constructed and arranged to move the forming roller through a succession of angularly-spaced paths along the end portion of the tube, at least some of the paths having straight portions that are generally tangent to the end portion of the tube; and a heating mechanism including an inductive heating element adapted for providing heat to the end portion of the tube.

2. The apparatus according to claim 1 wherein the forming roller is a wheel-shaped roller.

3. The apparatus according to claim 1 wherein the forming roller is a cylindrical roller.

4. The apparatus according to claim 1 further comprising means for adjusting the orientation of the forming roller as the forming roller moves through the succession of paths such that the axis of rotation of the forming roller is never parallel to the straight portions of the paths.

5. The apparatus according to claim 1 wherein the heating element comprises an inductive coil means.

6. The apparatus according to claim 5 wherein the inductive coil means includes two or more inductive coils that can move relative to each other to conform to the shape of the end portion of the tube.

7. The apparatus according to claim 5 wherein the inductive coil means has an inductive coil that includes two or more coil portions nonrigidly jointed together so that the coil portions can move relative to each other to conform to the shape of the end portion of the tube.

8. The apparatus according to claim 5 wherein the inductive coil means has a surface having a recessed central portion for positioning proximate to the end portion of the tube.

9. The apparatus according to claim 8 wherein the inductive coil means has a generally tube-segment-shaped coil with the concave surface facing the end portion to be heated.

10. The apparatus according to claim 1 wherein the inductive heating element is an inductive coil means having an inductive coil whose orientation and position relative to the tube is reconfigurable to conform to the shape of the end portion of the tube.

11. The apparatus according to claim 10 wherein the inductive coil means has a plurality of coils independently movable relative to the tube to remain proximate to the end portion of the tube for inductive heating as the end portion of the tube changes shape.

12. The apparatus according to claim 1 wherein the inductive heating element is free to move axially and radially with respect to the tube along a plane that includes the longitudinal axis of the tube, and the inductive coil means is pivotally moveable about a pivot axis that is aligned generally perpendicular to the plane.

13. The apparatus according to claim 1 further comprising:

sensors for measuring the temperature of the tube, the pressure exerted on the tube by the forming roller, and the speed of rotation of the tube;

a processing unit interfacing with the sensors, the heating mechanism, the forming roller mechanism, and the means for rotating the tube, the processing unit being adapted to process input data generated by the sensors and automatically control the forming roller mechanism, the heating mechanism, and the means for rotating the tube such that the end portion of the tube is formed to a desired shape.

14. The apparatus according to claim 1 wherein the rotating means comprises a means for securing the tube in the means for rotating wherein the means for securing is adapted to secure a tube that is out-of-round.

15. The apparatus according to claim 1 wherein the apparatus is adapted to construct a tube of diameter to thickness ratio of greater than 50:1 and result in an arcuate portion having a thickness of 1.0 to 2. 5 times the original thickness of the tube.

16. A method for constricting an end of a metallic tube to form an arcuate-walled portion, the arcuate-walled portion having an outer surface, the method comprising:

(a) rotating the tube on its axis;

(b) inductively heating an end portion of the tube; and (c) applying pressure on the end portion of the tube along successive lines of contact, each line of contact having a substantially straight portion that is generally tangential to the outer surface of the arcuate-walled portion, to progressively constrict the end of the tube.

17. The method according to claim 16 wherein the pressure is applied by a forming roller moving along a succession of paths having straight portions between proximal and distal, radially inward and radially outward end points relative to the tube so that metal of the tube is spun radially inward and distally with the travel of the forming roller on each successive path and wherein the inductive heating is by means of an inductive coil means having a movable generally tube-segment-shaped inductive coil having a concave surface suitable for positioning proximate to the end portion of the tube as the tube changes shape.

18. The method according to claim 16 wherein the inductive coil means is moved to position the inductive coil proximate the end portion of the tube as the tube changes shape.

19. A method for constricting a distal end of a metallic tube, the method comprising the steps of:

rotating the tube about its longitudinal axis;

engaging the tube with a forming roller at a forming region located near the distal end;

inductively heating the tube with an inductive heating element, the tube being heated at a heating region located adjacent to the distal end; and causing relative movement between the forming roller and the tube such that the forming region at which the roller engages the tube progressively and non-reciprocally moves axially toward the distal end of the tube and radially toward the longitudinal axis of the tube, wherein as the forming region moves, the forming roller incrementally constricts the distal end of the tube.

20. The method of claim 19, further comprising the steps of causing relative movement between the inductive heating element and the tube such that the heating region heated by the inductive heating element moves progressively and non-reciprocally toward the distal end of the tube and radially toward the longitudinal axis of the tube; and orchestrating the positioning of the inductive heating element and the forming roller such that the heating region heated by the inductive heating element generally coincides with the forming region at which the forming roller engages the tube.

21. The method of claim 19, wherein the forming region is moved axially toward the distal end of the tube and radially toward the longitudinal axis of the tube by moving the forming roller through a succession of angularly-spaced paths having straight portions that are generally tangent to the tube at the forming region.

22. The method of claim 21, wherein the paths include an initial path aligned at an oblique angle with respect to the longitudinal axis of the tube, and a final path aligned generally at a transverse angle with respect to the longitudinal axis of the tube.

23. The method according to claim 19, wherein the forming roller is a wheel-shaped roller.

24. The method according to claim 19, wherein the forming roller is an elongated cylindrical roller.

25. The method of claim 23, wherein the elongated cylindrical roller has a central axis of rotation passing longitudinally therethrough, and the forming region is moved axially toward the distal end of the tube and radially toward the longitudinal axis of the tube by progressively pivoting the forming roller from a first position in which the central axis forms an oblique angle with respect to the longitudinal axis of the tube, toward a second position in which the central axis generally forms a transverse angle with respect to the longitudinal axis of the tube.

26. The method of claim 19, wherein the inductive heating element has a concave surface facing an outer surface of the tube.

27. A method for consisting a distal end of a metallic tube, the method comprising:

rotating the tube about its longitudinal axis;

applying heat and pressure to a localized region located near the distal end of the tube so as to create a localized forming region;

progressively and non-reciprocally moving the application of heat and pressure axially toward the distal end of the tube and radially toward the longitudinal axis of the tube causing the localized forming region to progressively and non-reciprocally move axially toward the distal end of the tube and radially toward the longitudinal axis of the tube, wherein as the localized forming region is progressively moved, a formed region is left behind the localized forming region, and an unformed region is progressively heated and formed to a desired arcuate shape; and allowing the formed region to cool as the unformed region is concurrently heated and formed to the desired shape.

28. The method of claim 27, wherein the pressure is applied with a forming roller.

29. The method according to claim 28, wherein the forming roller is a wheel-shaped roller.

30. The method according to claim 28, wherein the forming roller is an elongated cylindrical roller.

31. An apparatus for constricting a distal end of a metallic tube, the apparatus comprising:

structure for rotating the tube about its longitudinal axis;

a forming mechanism including a forming roller adapted for engaging the tube at a forming region, the forming mechanism being constructed and arranged for moving the forming roller axially and radially with respect to the tube;

a heating mechanism including a heating element adapted for heating the tube at a heating region that coincides generally with the forming region, the heating mechanism being constructed and arranged for moving the heating element axially and radially with respect to the tube; and a control means interfacing with the forming mechanism and the heating mechanism, the control means controlling the forming mechanism and the heating mechanism such that when the apparatus is used to constrict the tube, the forming and heating regions concurrently and non-reciprocally move radially toward the longitudinal axis of the tube and axially toward the distal end of the tube, wherein as the forming and heating regions move with respect to the tube, a formed region left behind the heating and forming regions is allowed to cool, and an unformed region is progressively heated and formed to a desired shape.

32. The apparatus of claim 31, wherein the forming roller mechanism moves the forming roller through a succession of angularly-spaced paths having straight portions that are generally tangent to the tube at the forming region.

33. The apparatus of claim 31, wherein the forming roller is an elongated cylinder having a central axis of rotation passing longitudinally therethrough, and the forming region is moved axially toward the distal end of the tube and radially toward the longitudinal axis of the tube by pivoting the forming roller from a first position in which the central axis forms an oblique angle with respect to the longitudinal axis of the tube, toward a second position in which the central axis generally forms a transverse angle with respect to the longitudinal axis of the tube.

* * * * *

UNITED STATES PATENT AND TRADEMARK OFFICE

CERTIFICATE OF CORRECTION

PATENT NO. : 5,598,729

DATED : February 4, 1997

INVENTOR(S) : Hoffmann et al.

It is certified that error appears in the above-identified patent and that said Letters Patent is hereby corrected as shown below:

Title page in [54] Title and in Col. 1, line 2: "CONSTRUCTING" should read --CONSTRICTING--

Col. 18, line 19: "Left" should read --left--

Col. 26, line 58: "GetSpecialPlotlnfo" should read --GetSpecialPlotInfo--

Col. 31, claim 27, line 1: "consisting" should read --constricting--

Signed and Sealed this

Thirteenth Day of January, 1998

Bruce Lehman

*Attest:*

BRUCE LEHMAN

*Attesting Officer*

*Commissioner of Patents and Trademarks*